US010029157B2

(12) United States Patent
Sugimoto et al.

(10) Patent No.: US 10,029,157 B2
(45) Date of Patent: Jul. 24, 2018

(54) GOLF CLUB HEAD

(71) Applicant: DUNLOP SPORTS CO. LTD., Kobe-shi, Hyogo (JP)

(72) Inventors: Yasushi Sugimoto, Kobe (JP); Takahiro Norimura, Kobe (JP); Daisuke Kohno, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/331,295

(22) Filed: Oct. 21, 2016

(65) Prior Publication Data

US 2017/0113107 A1 Apr. 27, 2017

(30) Foreign Application Priority Data

Oct. 23, 2015 (JP) ..... 2015-208630

(51) Int. Cl.
*A63B 53/04* (2015.01)
*A63B 60/54* (2015.01)

(52) U.S. Cl.
CPC ..... *A63B 53/047* (2013.01); *A63B 60/54* (2015.10); *A63B 2053/0408* (2013.01); *A63B 2053/0416* (2013.01); *A63B 2053/0433* (2013.01); *A63B 2053/0458* (2013.01); *A63B 2053/0491* (2013.01)

(58) Field of Classification Search
CPC ..... A63B 53/047
See application file for complete search history.

(56) References Cited

U.S. PATENT DOCUMENTS 6,364,789 B1 * 4/2002 Kosmatka ..... A63B 53/04 473/329
7,160,204 B2 * 1/2007 Huang ..... A63B 53/04 473/342
8,033,931 B2 * 10/2011 Wahl ..... A63B 53/047 473/342
8,777,776 B2 * 7/2014 Wahl ..... A63B 53/0466 473/342
9,662,545 B2 * 5/2017 Beach ..... A63B 53/0466

FOREIGN PATENT DOCUMENTS

JP 2691496 B2 12/1997

* cited by examiner

*Primary Examiner* — Michael Dennis
(74) *Attorney, Agent, or Firm* — Birch, Stewart, Kolasch & Birch, LLP

(57) ABSTRACT

A head 2 includes a head body h1 and a face plate p1 fixed to the head body h1. The face plate p1 includes a plate front surface f1 having a hitting face, a plate back surface b1, and a plate side surface s1. The head body h1 includes a body side surface v1 opposed to the plate side surface s1. A gap gp is provided at at least a part between the plate side surface s1 and the body side surface v1.

13 Claims, 25 Drawing Sheets

GOLF CLUB HEAD

The present application claims priority on Patent Application No. 2015-208630 filed in JAPAN on Oct. 23, 2015, the entire contents of which are hereby incorporated by reference.

BACKGROUND OF THE INVENTION

Field of the Invention

The present invention relates to a golf club head.

Description of the Related Art

There has been known an iron type golf club head including a head body and a face plate attached to the head body. Japanese Patent No. 2691496 discloses a head, wherein a projection engaged with a recess of a face body to fix the face body to a head body is formed by the plastic deformation of a part of the head body.

SUMMARY OF THE INVENTION

The present inventors have found that a non-conventional new structure is allowed in a head to which a face plate is attached. This new structure can exhibit an effect heterogeneous from the effect of the conventional technique.

It is an object of the present invention to provide a golf club head having a structure where a face plate is attached to a head body, and having a new effect.

A preferable golf club head includes a head body and a face plate fixed to the head body. The face plate includes a plate front surface having a hitting face, a plate back surface which is a surface opposite to the plate front surface, and a plate side surface. The head body includes a body side surface opposed to the plate side surface. A gap is provided at at least apart between the plate side surface and the body side surface.

Preferably, the plate side surface includes a plate recess. Preferably, the plate recess forms the gap.

Preferably, the body side surface includes a body recess. Preferably, the body recess forms the gap.

Preferably, a peripheral part of the plate front surface includes a level difference surface located at back with respect to the hitting face. Preferably, the head body includes a plastic deforming part covering front of the level difference surface. Preferably, the level difference surface and the plastic deforming part are provided in at least apart of a region corresponding to the gap.

Preferably, the head further includes a resin member. Preferably, the resin member is disposed in the gap.

Preferably, the plate side surface includes a top side region, a sole side region, a toe side region, and a heel side region. Preferably, the plate side surface is brought into contact with the body side surface in each of the top side region, the sole side region, the toe side region, and the heel side region.

DESCRIPTION OF THE PREFERRED EMBODIMENTS

Hereinafter, the present invention will be described in detail according to the preferred embodiments with appropriate references to the accompanying drawings.

In the present application, the following terms are defined.

[Base State]

The base state is in a state where a head is placed at a specified lie angle and real loft angle on a level surface h. In the base state, a center axis line (shaft axis line) of a shaft hole of the head is provided in a vertical plane VP1. The vertical plane VP1 is a plane perpendicular to the level surface h. In the base state, a face surface (hitting face) is inclined at a real loft angle with respect to the vertical plane VP1. The specified lie angle and real loft angle are described in, for example, a product catalog or the like.

[Toe-Heel Direction]

In the head of the base state, a direction of an intersection line between the vertical plane VP1 and the level surface h is the toe-heel direction. A toe side and a heel side used in the present application should be based on the toe-heel direction.

[Face-Back Direction]

A direction perpendicular to the toe-heel direction and parallel to the level surface h is the face-back direction. A face side and a back side used in the present application should be based on the face-back direction.

[Front-Rear Direction]

A direction perpendicular to the hitting face is defined as the front-rear direction. In other words, a normal direction of the hitting face is defined as the front-rear direction. Front and rear used in the present application should be based on the front-rear direction.

[Up-Down Direction]

A direction perpendicular to the toe-heel direction and parallel to the hitting face is the up-down direction. Above and below used in the present application should be based on the up-down direction.

[Vertical Up-Down Direction]

A direction of a straight line perpendicular to the level surface h is the vertical up-down direction. Vertically above and vertically below used in the present application should be based on the vertical up-down direction.

Figure 1:
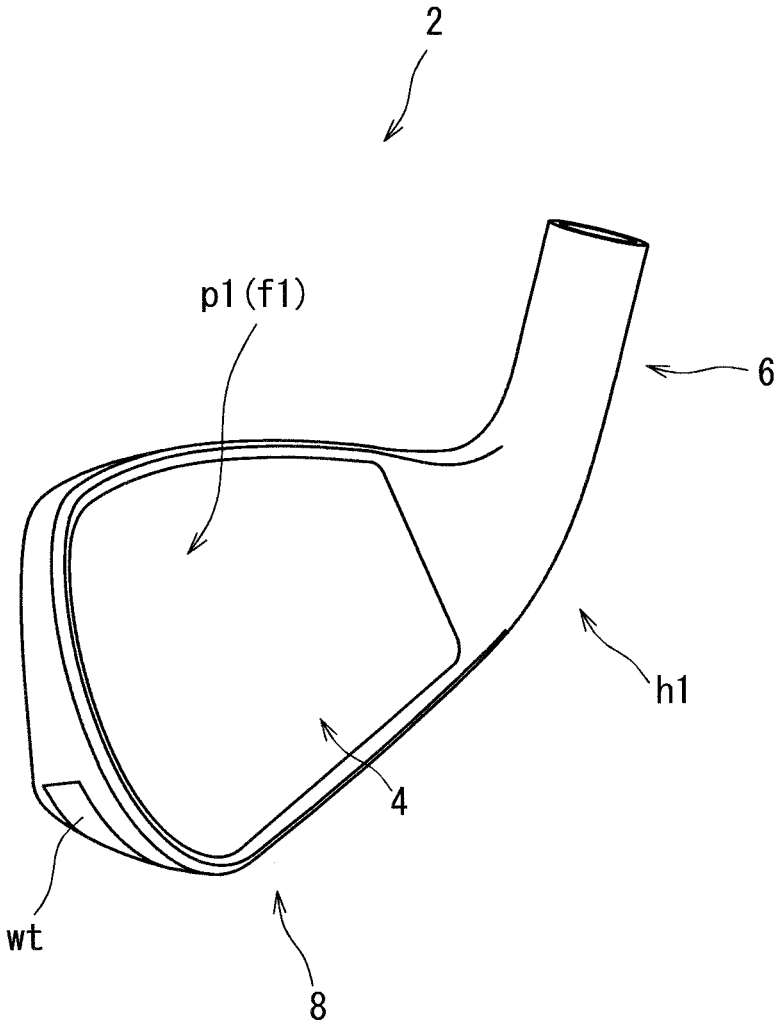
FIG. 1 is a perspective view of a golf club head of a first embodiment.
Figure 2:
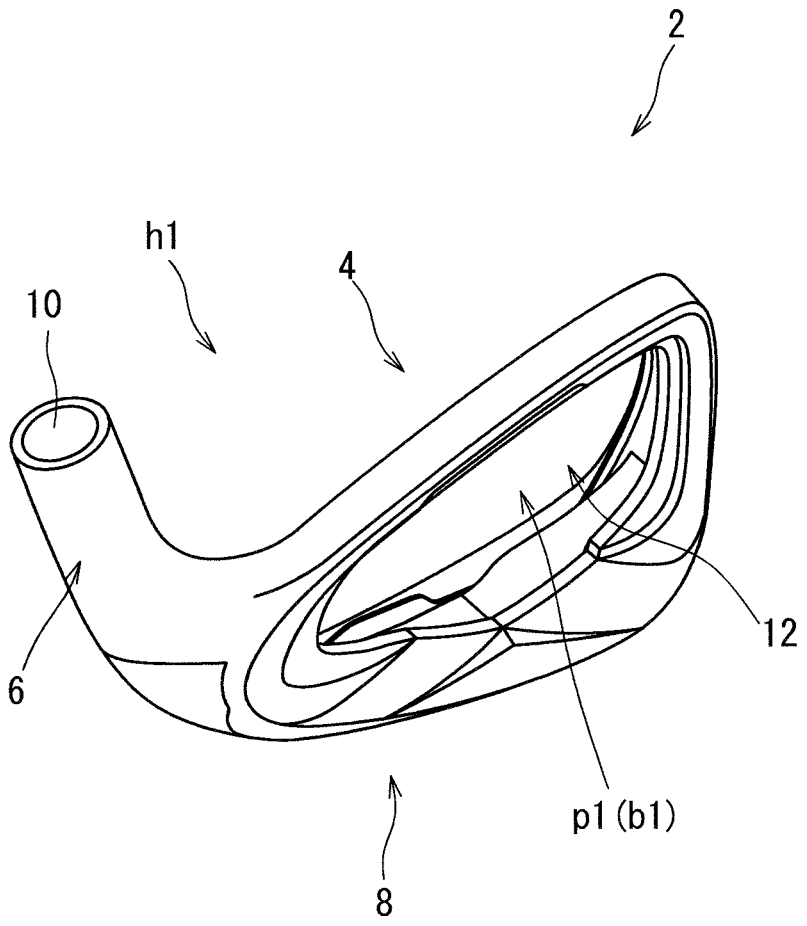
FIG. 2 is a perspective view showing the back surface of the head of FIG. 1.
Figure 3:
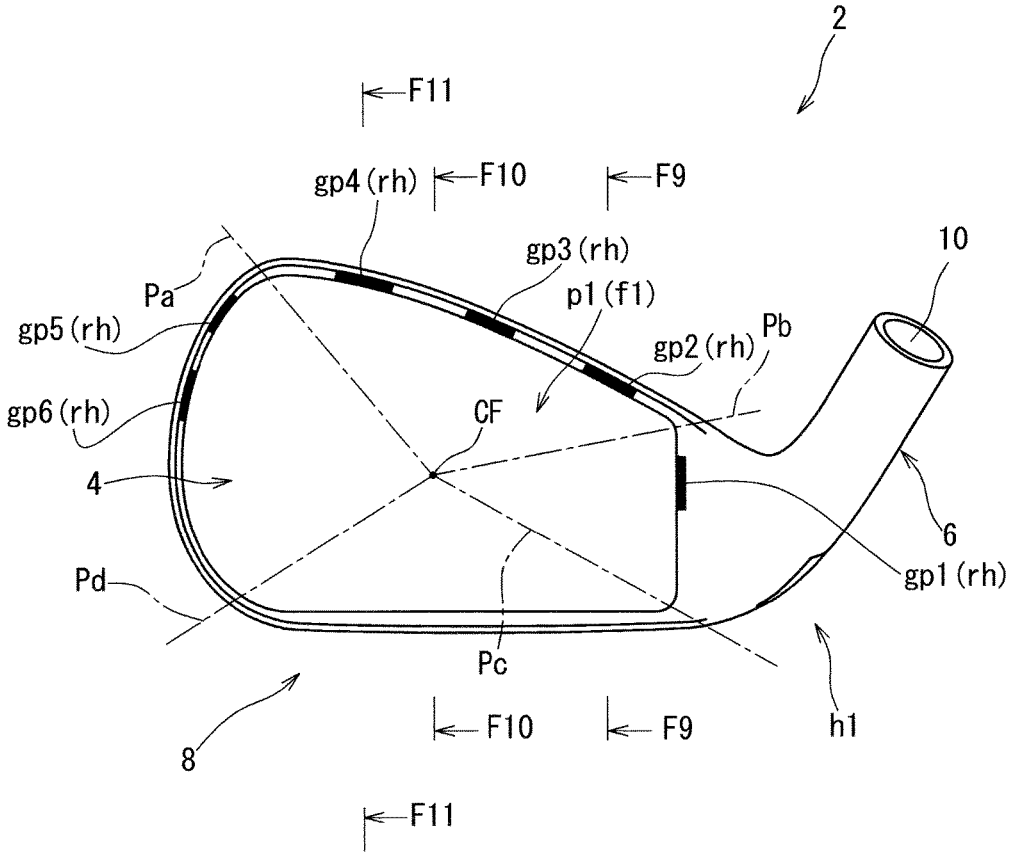
FIG. 3 is a front view of the head of FIG. 1.
Figure 4:
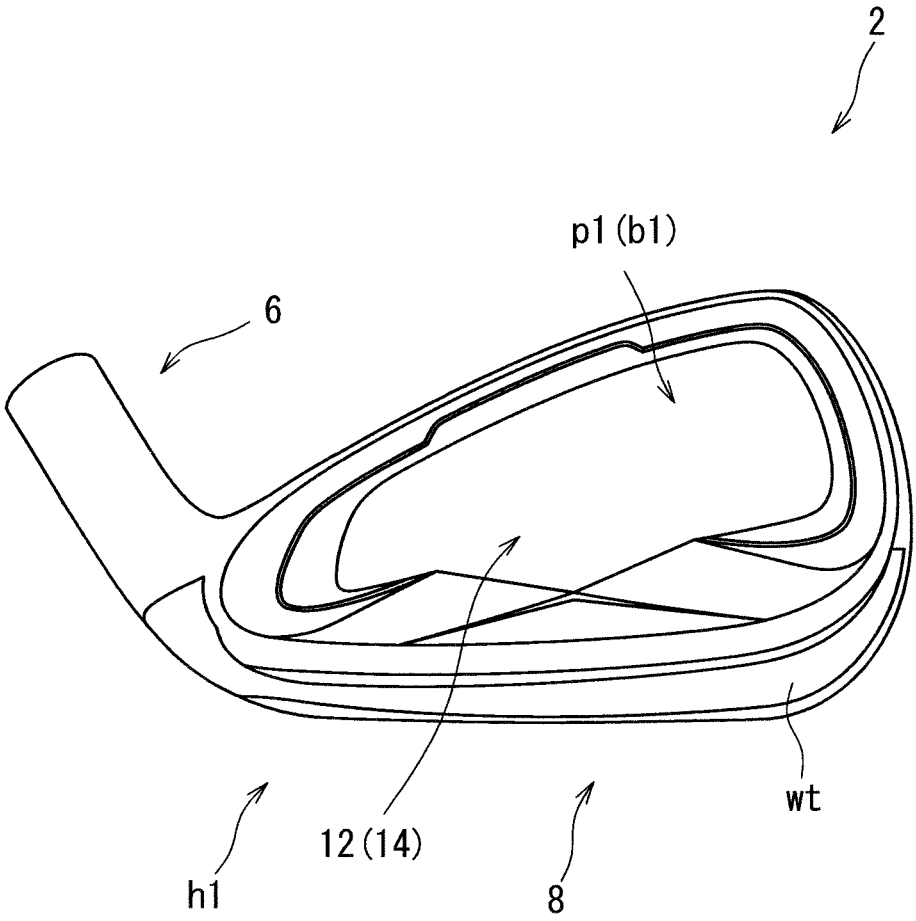
FIG. 4 is a back view of the head of FIG. 1.

FIG. 1 is a perspective view of a golf club head 2 according to a first embodiment of the present invention when the golf club head 2 is seen from an obliquely front side. FIG. 2 is a perspective view of the head 2 when the head 2 is seen from an obliquely back side. FIG. 3 is a front view of the head 2. FIG. 3 is a front view of the hitting face. FIG. 4 is a back view of the head 2.

The head 2 includes a face 4, a hosel 6, and a sole 8. The hosel 6 has a hosel hole 10. The face 4 is the hitting face. Although face grooves is formed in the surface of the face 4, the description of the face grooves is omitted. A weight member wt is disposed in the sole 8. The head 2 is an iron type golf club head.

A back cavity 12 is provided on a side opposite to the face 4. The head 2 is a cavity back iron.

The head 2 includes a head body h1 and a face plate p1 fixed to head body h1. The head body h1 is made of a metal. In the present embodiment, the head body h1 is made of stainless steel. The face plate p1 is made of a metal. In the present embodiment, the face plate p1 is made of a titanium-based metal. The titanium-based metal means pure titanium or a titanium alloy. The materials of the head body h1 and face plate p1 are not limited.

The titanium alloy is an alloy containing 50% by weight or greater of titanium. Examples of the titanium alloy include α titanium, αβ titanium, and β titanium. Examples of the α titanium include Ti-5Al-2.5Sn and Ti-8Al-1V-1Mo. Examples of the αβ titanium include Ti-6Al-4V, Ti-6Al-2Sn-4Zr-6Mo, Ti-6Al-6V-2Sn, and Ti-4.5Al-3V-2Fe-2Mo. Examples of the β titanium include Ti-15V-3Cr-3Sn-3Al, Ti-20V-4Al-1Sn, Ti-22V-4Al, Ti-15Mo-2.7Nb-3Al-0.2Si, and Ti-16V-4Sn-3Al-3Nb. Examples of the pure titanium include industry pure titanium. Examples of the industry pure titanium include pure titanium of type 1, pure titanium of type 2, pure titanium of type 3, and pure titanium of type 4 which are prescribed by Japanese Industrial Standard.

Preferably, the specific gravity of the face plate p1 is smaller than the specific gravity of the head body h1. The face plate p1 having a smaller specific gravity contributes to the distribution of the weight of the head 2 to the circumference.

Figure 5:
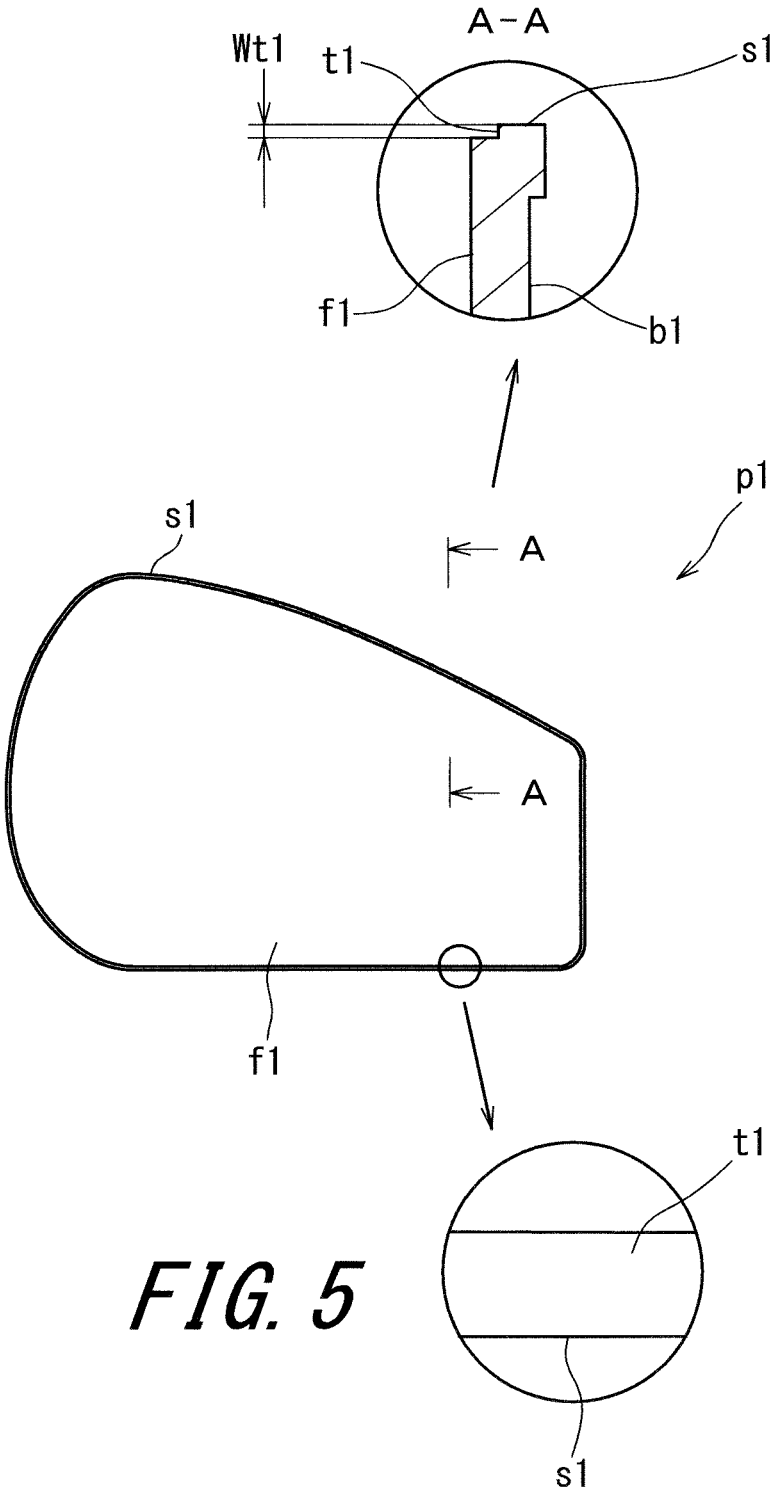
FIG. 5 is a plan view of a face plate according to the head of FIG. 1.
Figure 6:
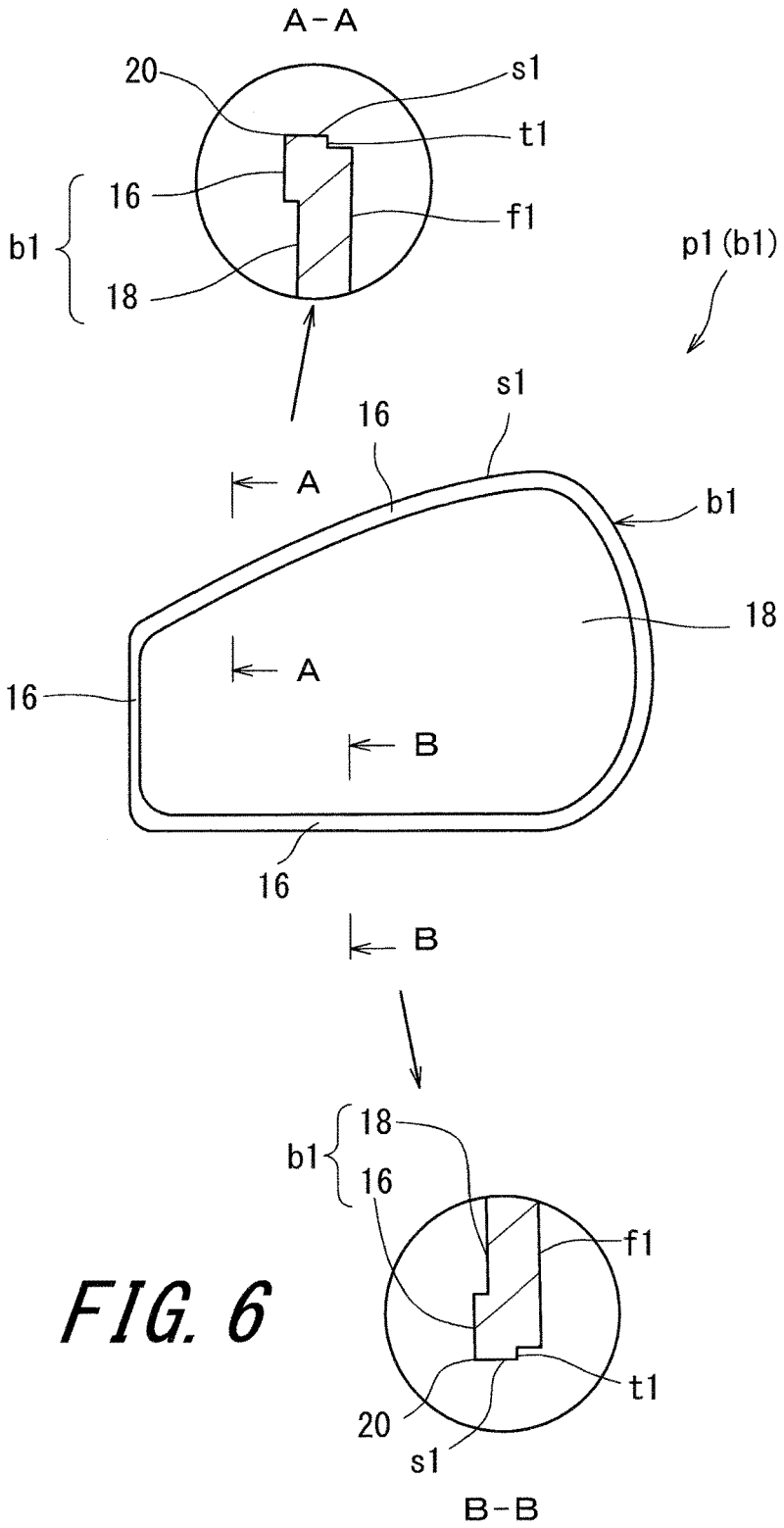
FIG. 6 is a back view of the face plate of FIG. 5.

FIG. 5 is a plan view of the face plate p1. FIG. 6 is a back view of the face plate p1. The face plate p1 includes a plate front surface f1, a plate back surface b1, and a plate side surface s1. The plate front surface f1 includes a hitting face. The hitting face is a plane except for face grooves. The plate back surface b1 is a surface opposite to the plate front surface f1. The plate side surface s1 extends between the plate front surface f1 and the plate back surface b1.

Figure 7:
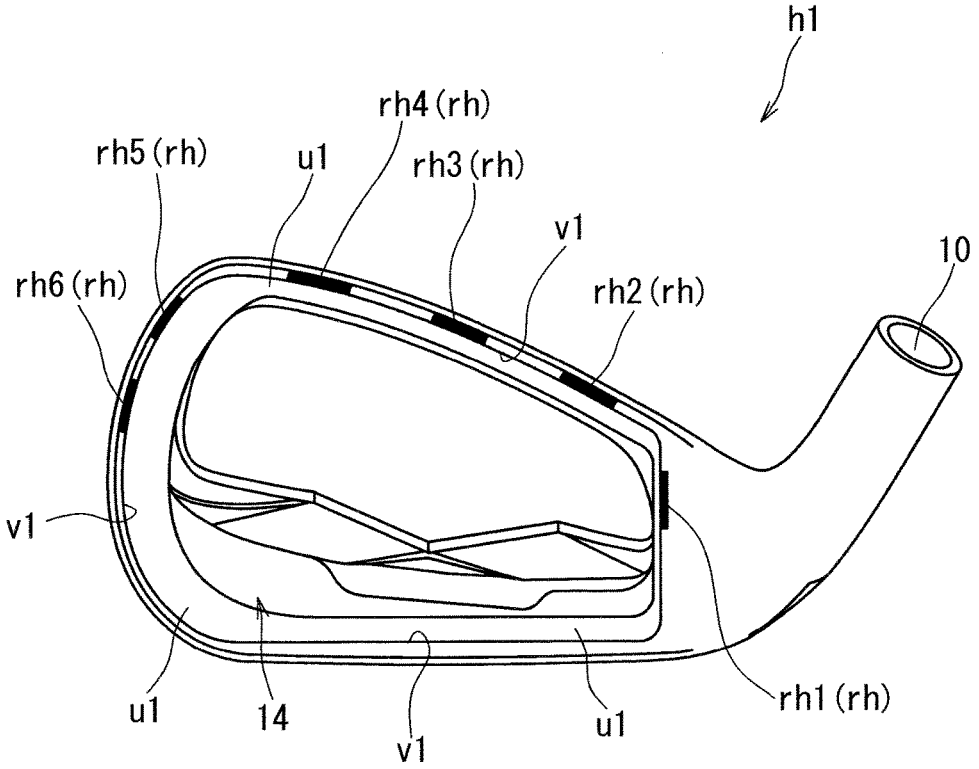
FIG. 7 is a front view of a head body according to the head of FIG. 1.

FIG. 7 is a front view of the head body h1. The head body h1 has an opening part 14. The contour of the opening part 14 is substantially equal to the contour of the face plate p1.

The head body h1 includes a receiving surface u1 which supports the plate back surface b1 of the face plate p1, and a body side surface v1 which is opposed to the plate side surface s1. The whole receiving surface u1 is constituted by a single plane. The receiving surface u1 is provided over the whole circumference of the opening part 14. The body side surface v1 is provided over the whole circumference of the face plate p1. A part of the plate back surface b1 is brought into contact with the receiving surface u1. In FIG. 7, the description of a plastic deforming part d1 (to be described later) is omitted.

Figure 8:
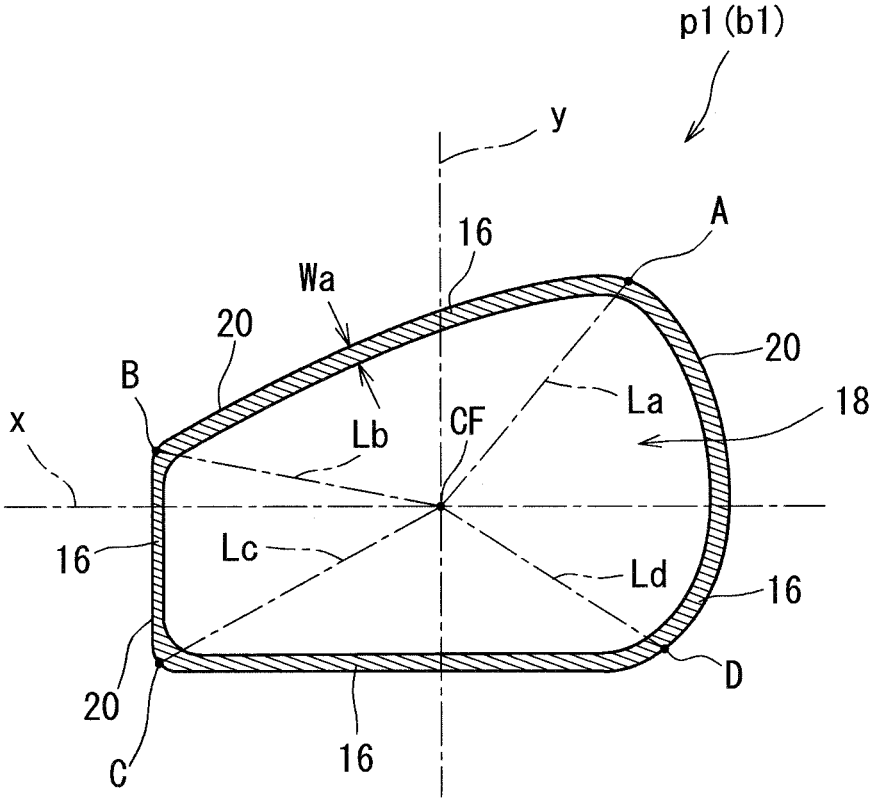
FIG. 8 is the same back view as FIG. 6, and an outer peripheral edge part is shown by hatching in FIG. 8.

FIG. 8 shows the plate back surface b1 as in FIG. 6. An outer peripheral edge part 16 is shown by hatching in FIG. 8. As shown in FIG. 8, the plate back surface b1 includes an outer peripheral edge part 16 having a circular shape, and an inner side part 18 located on the inner side of the outer peripheral edge part 16. The inner side part 18 is surrounded by the outer peripheral edge part 16.

The outer peripheral edge part 16 includes a contour line 20 of the plate back surface b1. That is, the outer contour line of the outer peripheral edge part 16 is the contour line 20. The outer peripheral edge part 16 has a width Wa. The width Wa is preferably equal to or greater than 1 mm, and more preferably equal to or greater than 1.3 mm. The width Wa is preferably equal to or less than 6 mm, and more preferably equal to or less than 5 mm.

A center of a figure of the plate back surface b1 is shown by reference character CF in FIG. 8. The center of a figure CF is determined based on the contour line 20 of the plate back surface b1.

In the plan view of FIG. 8, a straight line x and a straight line y are defined. The straight line x is a straight line passing through the center of a figure CF and being parallel to the toe-heel direction. The straight line y is a straight line passing through the center of a figure CF and being parallel to the up-down direction.

As shown in FIG. 8, the contour line 20 is sectioned into four by the straight line x and the straight line y. A point having the minimum curvature radius is determined in each of these four sections. A point having the smallest curvature radius in a toe upper side section is shown by reference character A. A point having the smallest curvature radius in a heel upper side section is shown by reference character B. A point having the smallest curvature radius in a heel lower side section is shown by reference character C. A point having the smallest curvature radius in a toe lower side section is shown by reference character D. A straight line which connects the point A and the center of a figure CF is a straight line La. A straight line which connects the point B and the center of a figure CF is a straight line Lb. A straight line which connects the point C and the center of a figure CF is a straight line Lc. A straight line which connects the point D and the center of a figure CF is a straight line Ld.

The head 2 may be comparted into four by three-dimensionally enlarging these straight lines. A plane Pa including the straight line La and being perpendicular to the hitting face, a plane Pb including the straight line Lb and being perpendicular to the hitting face, a plane Pc including the straight line Lc and being perpendicular to the hitting face, and a plane Pd including the straight line Ld and being perpendicular to the hitting face are defined (see FIG. 3). The head 2 is comparted into a toe side region, a heel side region, a top side region, and a sole side region by these four planes Pa, Pb, Pc, and Pd. Therefore, for example, each of the head body h1 and the face plate p1 is also comparted into the toe side region, the heel side region, the top side region, and the sole side region. Thus, the four regions (toe side region, heel side region, top side region, and sole side region) in the present application are defined. The toe side region, the heel side region, the top side region, and the sole side region are generically referred to as a four-section region.

The four-section region is applied to all the portions of the head 2. For example, the plate side surface s1 includes the toe side region, the heel side region, the top side region, and the sole side region. For example, the receiving surface u1 includes the toe side region, the heel side region, the top side region, and the sole side region. For example, the body side surface v1 includes the toe side region, the heel side region, the top side region, and the sole side region.

The outer peripheral edge part 16 forms a protruded part protruded to back of the inner side part 18. The thickness of the outer peripheral edge part 16 is greater than the thickness of the inner side part 18. As shown in FIG. 6, the outer peripheral edge part 16 is provided over the whole circumference of the face plate p1. The outer peripheral edge part 16 abuts on the head body h1. The inner side part 18 does not abut on the head body h1.

A protruded part corresponding to the outer peripheral edge part 16 can also be provided on the head body h1. However, when the specific gravity of the head body h1 is greater than the specific gravity of the face plate p1, the setting of the protruded part leads to an increase in a head weight. In addition, the shape of the head body h1 is more complicated than the shape of the face plate p1, which is less likely to subject the head body h1 to a process (for example, NC process). The face plate p1 has a plate shape, which is easily processed.

Figure 9:
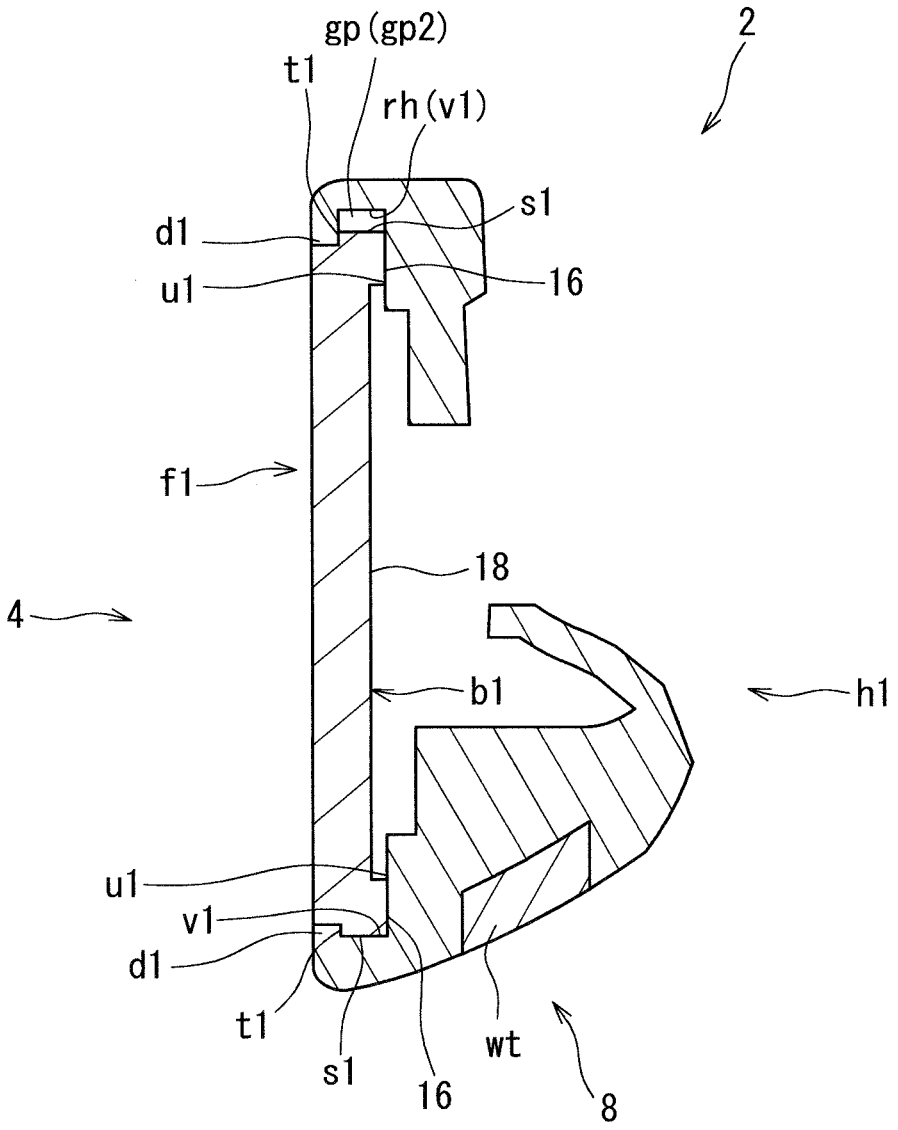
FIG. 9 is a sectional view taken along line F9-F9 of FIG. 3.
Figure 10:
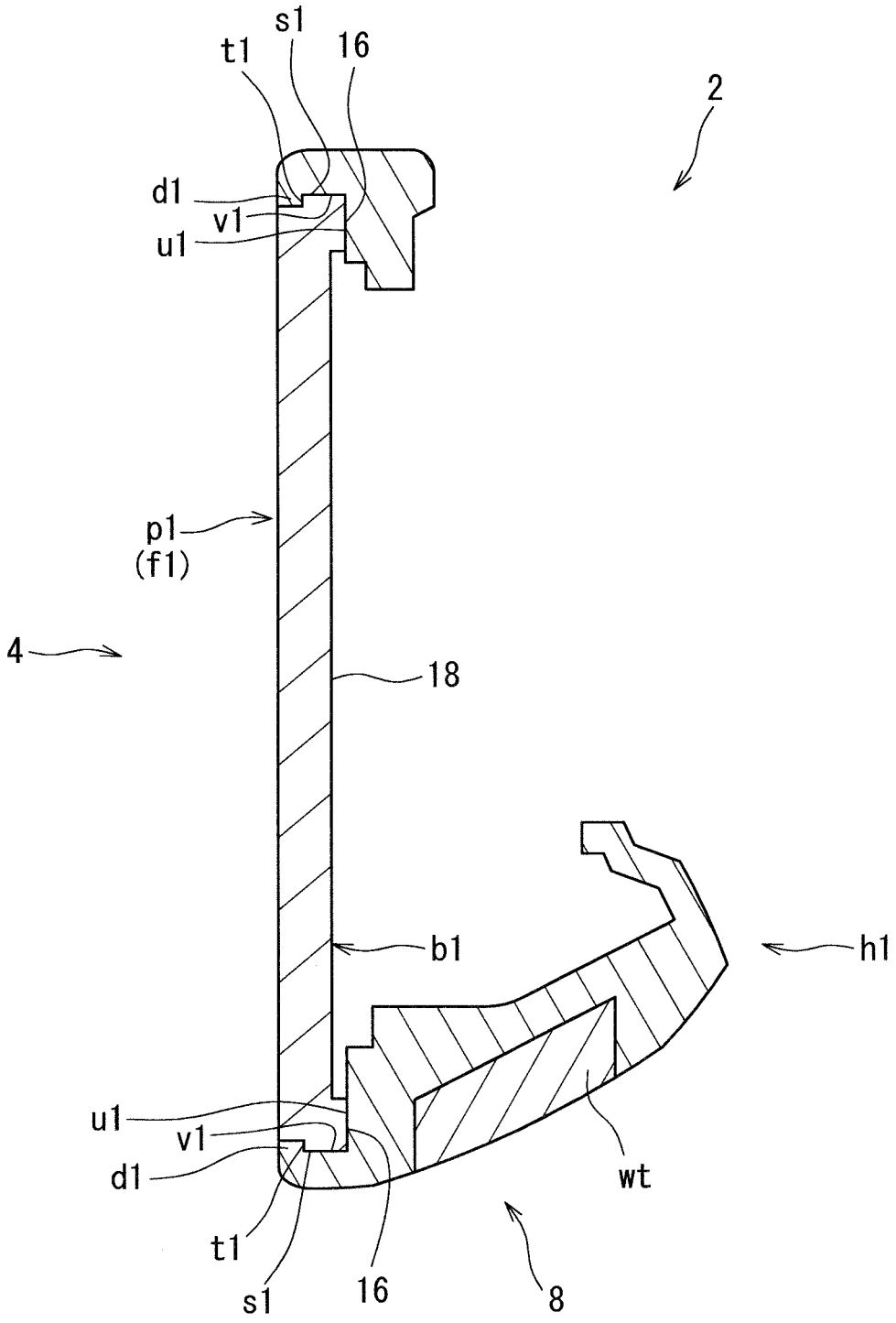
FIG. 10 is a sectional view taken along line F10-F10 of FIG. 3.
Figure 11:
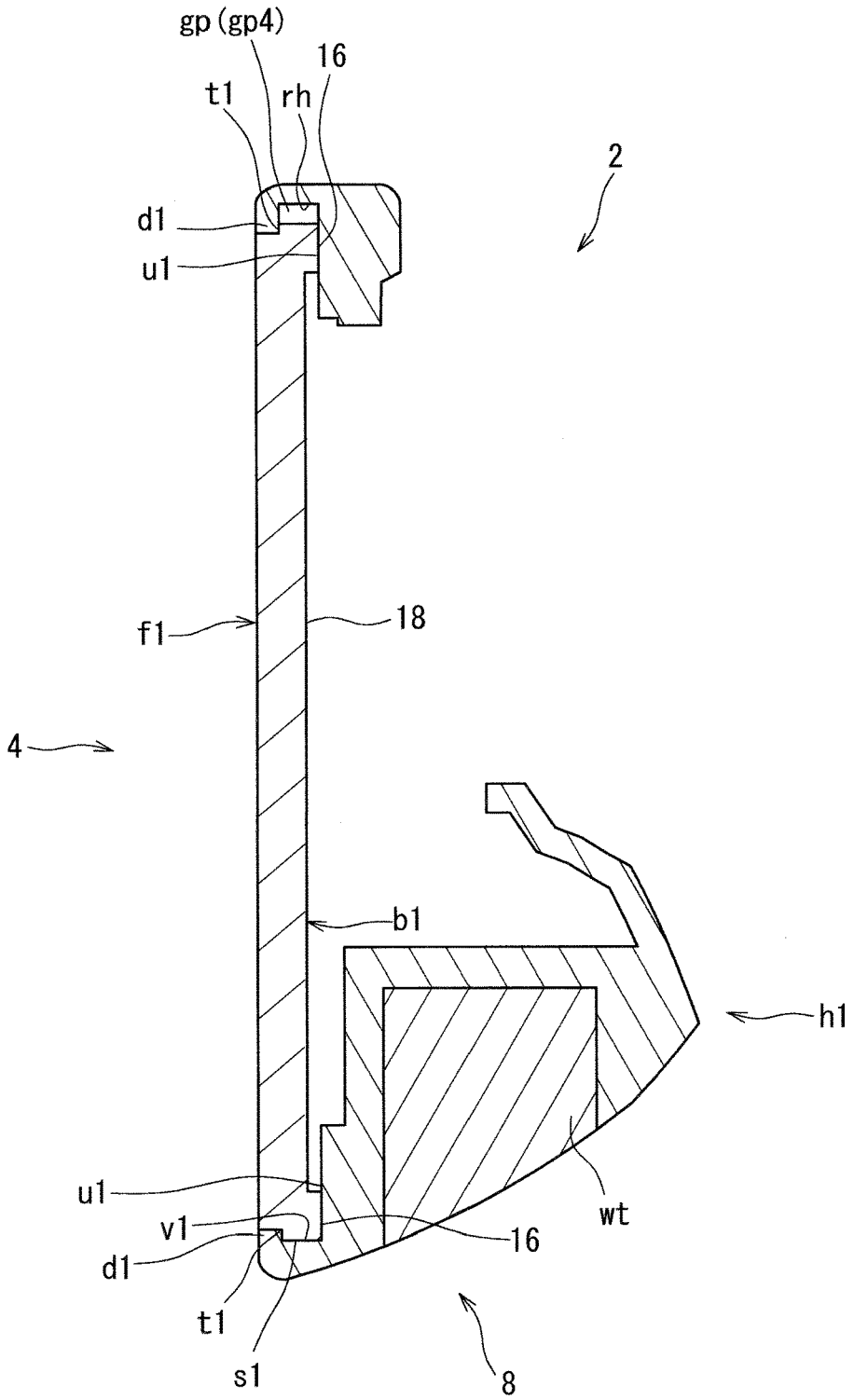
FIG. 11 is a sectional view taken along line F11-F11 of FIG. 3.

FIG. 9 is a sectional view taken along line F9-F9 of FIG. 3. FIG. 10 is a sectional view taken along line F10-F10 of FIG. 3. FIG. 11 is a sectional view taken along line F11-F11 of FIG. 3.

As shown in FIGS. 9, 10, and 11, the outer peripheral edge part 16 (protruded part) abuts on the receiving surface u1. The outer peripheral edge part 16 forms the protruded part protruded so that the outer peripheral edge part 16 abuts on the receiving surface u1. Meanwhile, the inner side part 18 does not abut on the receiving surface u1.

As shown in FIGS. 9, 10, and 11, the head body h1 includes the plastic deforming part d1. The plastic deforming part d1 is located at front of the face plate p1. In more detail, the plastic deforming part d1 is located at front of a level difference surface t1.

Figure 12A:
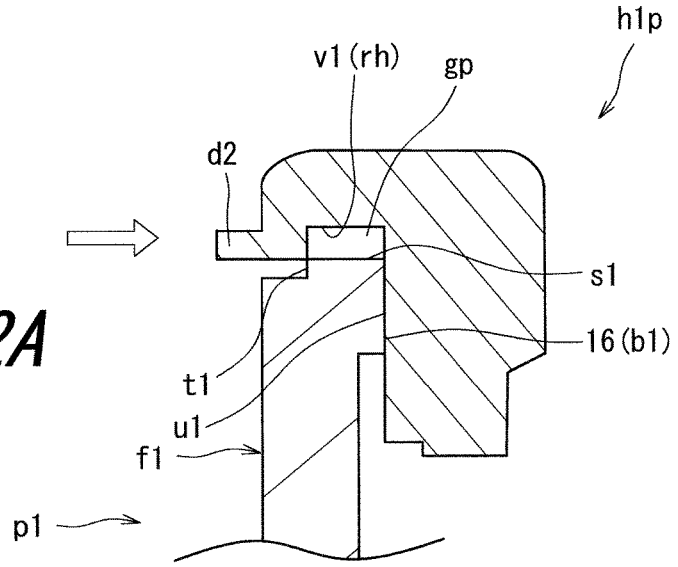
FIGS. 12A and 12B illustrate a step of forming a plastic deforming part (caulking step)
Figure 12B:
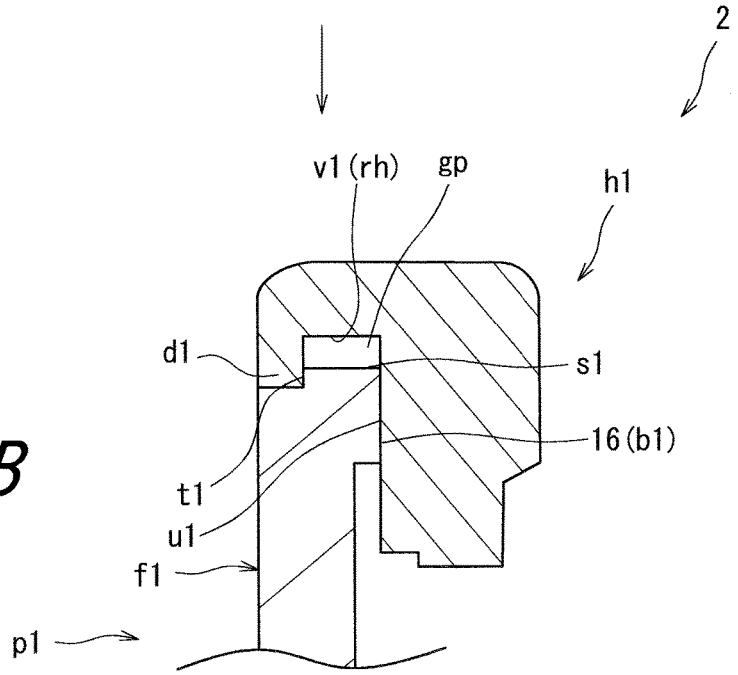

FIG. 12A and FIG. 12B show the procedure of the formation of the plastic deforming part d1.

As shown in FIG. 5 and FIG. 12A, a peripheral part of the plate front surface f1 includes a level difference surface t1 which is located at back with respect to the hitting face (face 4). As shown in FIG. 5, the level difference surface t1 is provided over the whole circumference of the face plate p1. As shown in FIG. 12B, the plastic deforming part d1 covers front of the level difference surface t1. The plastic deforming part d1 entirely covers level difference surface t1 provided over the whole circumference of the plate front surface f1.

From the viewpoint of fixing the face plate p1, a width Wt1 (see FIG. 5) of the level difference surface t1 is preferably equal to or greater than 0.2 mm, and more preferably equal to or greater than 0.3 mm. In light of the formation of the plastic deforming part d1, the width Wt1 is preferably equal to or less than 2 mm, and more preferably equal to or less than 1 mm.

In a method for forming the plastic deforming part d1, first, a head body h1*p* including an undeformed projection d2 (see FIG. 12A) is prepared. The head body h1*p* is also referred to as an undeformed body. The undeformed projection d2 is located at front of a gap gp (to be described later). As shown in FIG. 12A, the face plate p1 is set in the undeformed body h1*p*. Next, the undeformed projection d2 is crushed by a jig having a plane parallel to the hitting face. The undeformed projection d2 and its circumference portion are plastic-deformed to move to a space located at front of the level difference surface t1. As a result, at least a part of the space located at front of the level difference surface t1 is filled, which provides the formation of the plastic deforming part d1. The step is also referred to as a caulking step. The plastic deforming part d1 is also referred to as a caulking part.

Such a process method may cause a stress to remain in the plastic deforming part d1. The plastic deforming part d1 may press the face plate p1. The plastic deforming part d1 may press the level difference surface t1.

Since the plastic deforming part d1 is located at front of the face plate p1, the plastic deforming part d1 physically prevents the face plate p1 from coming off to front. Furthermore, since the plastic deforming part d1 is formed by plastic deformation, the plastic deforming part d1 presses the face plate p1. The plastic deforming part d1 contributes to the fixation of the face plate p1.

In the present embodiment, the undeformed projection d2 is provided over the whole circumference of the opening part 14. The process is entirely applied to the undeformed projection d2. As a result, the plastic deforming part d1 is provided over the whole circumference of the face plate p1.

As shown in FIG. 12B, the head 2 includes the gap gp. The gap gp is provided between the plate side surface s1 and the body side surface v1. The gap gp forms a space. The gap gp forms a hollow part.

A position in which the gap gp is provided is shown by a thick line in FIG. 3. In FIG. 7, the position of a body recess rh which forms the gap gp is shown by a thick line. Since the gap gp is the hollow part, in fact, the gap gp is not visually recognized from the outside of the head 2. In the present embodiment, a plurality of gaps gp are provided. In the present embodiment, a plurality of body recesses rh are provided.

As shown in FIG. 3, the head 2 includes a first gap gp1, a second gap gp2, a third gap gp3, a fourth gap gp4, a fifth gap gp5, and a sixth gap gp6. The head 2 includes the gap gp1 located in the heel side region. The head 2 includes the gaps gp2, gp3, and gp4 located in the top side region. The head 2 includes the gaps gp5 and gp6 located in the toe side region. The head 2 includes the gaps gp1, gp2, and gp3 located on a heel side with respect to the center of a figure CF. The head 2 includes the gaps gp4, gp5, and gp6 located on a toe side with respect to the center of a figure CF. The head 2 includes the gaps gp2 and gp3 located in the top side region and located on a heel side with respect to the center of a figure CF. The head 2 includes the gap gp4 located in the top side region and located on a toe side with respect to the center of a figure CF. The head 2 includes the gaps gp5 and gp6 located in the toe side region and located above the center of a figure CF. In the head 2, the gap gp is not provided in the sole side region.

A recess rh is formed in the body side surface v1 of the head body h1 in order to form the gap gp. In order to distinguish the recess rh from another recess, the recess rh is also referred to as a body recess. The body side surface v1 includes a body recess rh. The body recess rh is easily formed. For example, when the head body h1 is a cast article, the body recess rh can be integrally formed by the casting. The body recess rh may be formed by an NC process. The body side surface v1 is opened in the head body h1*p* before the face plate p1 is fitted. Therefore, the body recess rh is easily processed to the body side surface v1.

As shown in FIG. 7, the head body h1 includes a plurality (six) of body recesses rh. In more detail, the head body h1 includes a first body recess rh1, a second body recess rh2, a third body recess rh3, a fourth body recess rh4, a fifth body recess rh5, and a sixth body recess rh6. The head body h1 includes the body recess rh1 located in the heel side region. The head body h1 includes the body recesses rh2, rh3, and rh4 located in the top side region. The head body h1 includes the body recesses rh5 and rh6 located in the toe side region. The head body h1 in the head 2 includes the body recesses rh1, rh2, and rh3 located on a heel side with respect to the center of a figure CF. The head body h1 in the head 2 includes the body recesses rh4, rh5, and rh6 located on a toe side with respect to the center of a figure CF. The head body h1 in the head 2 includes the body recesses rh2 and rh3 located in the top side region and located on a heel side with respect to the center of a figure CF. The head body h1 in the head 2 includes the body recess rh4 located in the top side region and located on a toe side with respect to the center of a figure CF. The head body h1 in the head 2 includes the body recesses rh5 and rh6 located in the toe side region and located above the center of a figure CF. In the head body h1, the body recess rh is not provided in the sole side region.

The body recess rh reduces the rigidity of the head body h1. The body recess rh reduces the rigidity of the head body h1 on the circumference of the face plate p1. The reduction in the rigidity can promote the elastic deformation of the face plate p1. The elastic deformation of the face plate p1 contributes to an improvement in rebound performance. The body recess rh functions as a face deformation promoting part.

The gap gp formed by the body recess rh has a weight distribution effect. The gap gp is a redistribution weight creating part. The weight reduced by forming the gap gp can be redistributed to other sites of the head 2. The gap gp improves the degree of freedom of head designs.

For example, the gap gp can be disposed so that the center of gravity of the head is low. For example, the gap gp located vertically above the center of gravity of the head contributes to the lowering of the center of gravity of the head.

For example, the gap gp can be disposed so that the upper-and-lower moment of inertia of the head is increased. If an axis passing through the center of gravity of the head and being parallel to the toe-heel direction is defined as Ax, the upper-and-lower moment of inertia is a moment of inertia about the axis Ax. The gap gp located in the toe side region and the heel side region can contribute to an increase in the upper-and-lower moment of inertia.

For example, the gap gp can be disposed so that the left-and-right moment of inertia of the head is increased. If an axis passing through the center of gravity of the head and being parallel to the vertical up-down direction is defined as Ay, the left-and-right moment of inertia is a moment of inertia about the axis Ay. The gap gp located in the top side region and the sole side region can contribute to an increase in the left-and-right moment of inertia. Particularly, the gap gp in which a toe-heel direction distance between the gap gp and the center of a figure CF is short can contribute to an increase in the left-and-right moment of inertia.

In the head 2, the level difference surface t1 and the plastic deforming part d1 are provided in a region corresponding to the gap gp (body recess rh) (see FIGS. 9 and 11). For this reason, the face plate p1 is more certainly fixed. As described later, the constitution can suppress the poor formation of the plastic deforming part d1.

Figure 13:
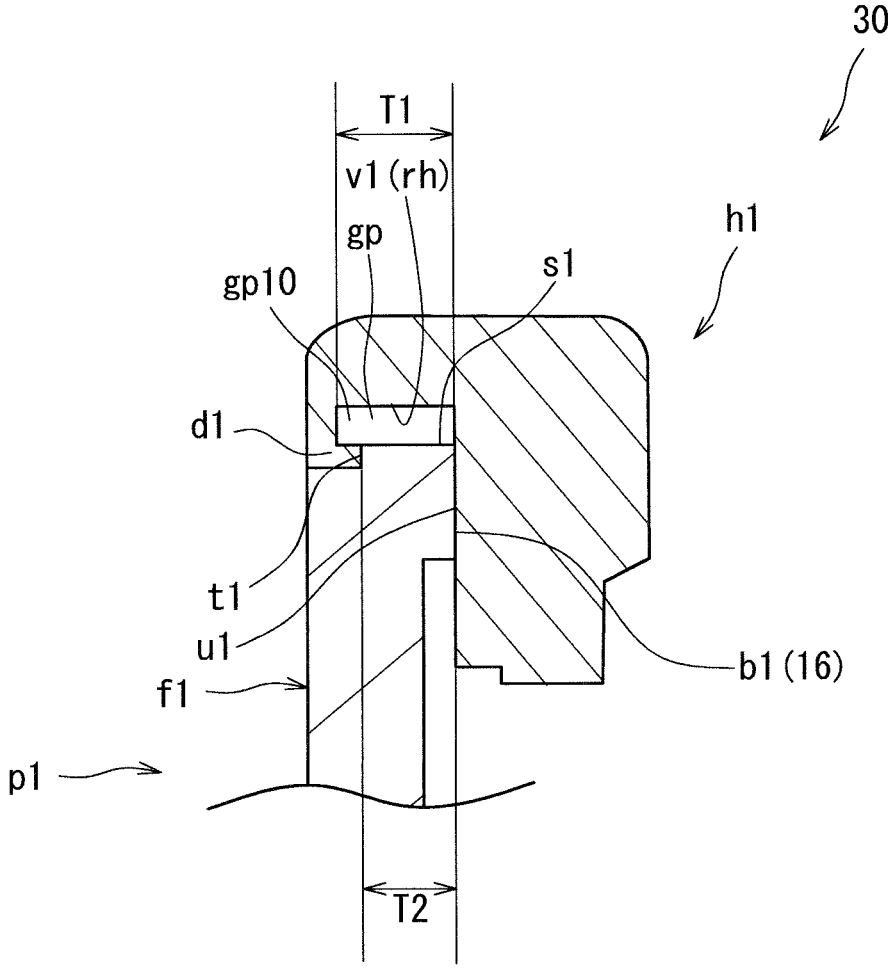
FIG. 13 is a partial sectional view of a head of a second embodiment.

FIG. 13 is a partial sectional view of a head 30 according to a second embodiment. Except for the form of a gap gp, the head 30 is the same as the above-mentioned head 2.

The head 30 includes a head body h1 and a face plate p1 fixed to the head body h1. The face plate p1 includes a plate front surface f1, a plate back surface b1, and a plate side surface s1. The plate front surface f1 includes a hitting face. The hitting face is a plane except for face grooves. The plate back surface b1 is a surface opposite to the plate front surface f1. The plate side surface s1 extends between the plate front surface f1 and the plate back surface b1. The head body h1 includes a receiving surface u1 which supports the plate back surface b1 of the face plate p1, and a body side surface v1 which is opposed to the plate side surface s1. A part of the plate back surface b1 (the protruded part 16) is brought into contact with the receiving surface u1. The body side surface v1 of the head body h1 includes a body recess rh. The body recess rh is a recess formed in the head body h1.

The head 30 includes the gap gp. The body recess rh forms the gap gp. The gap gp is formed between the plate side surface s1 and the body side surface v1.

The gap gp includes a front part gp10 located at front with respect to a level difference surface t1. The front part gp10 contributes to a further reduction in the rigidity of the head body h1. The front part gp10 can contribute to a further improvement in rebound performance.

The front part gp10 can effectively reduce the rigidity of the head body h1 in a portion closer to a face surface of the head body h1. The front part gp10 highly contributes to rebound performance.

As shown in FIG. 13, a front-rear direction width T1 of the gap gp is greater than a front-rear direction width T2 between the level difference surface t1 and the receiving surface u1. In the above-mentioned head 2, the width T1 is the same as the width T2, and in the head 30, T1>T2 is set. The greater width T1 contributes to a further reduction in the rigidity of the head body h1.

Figure 14:
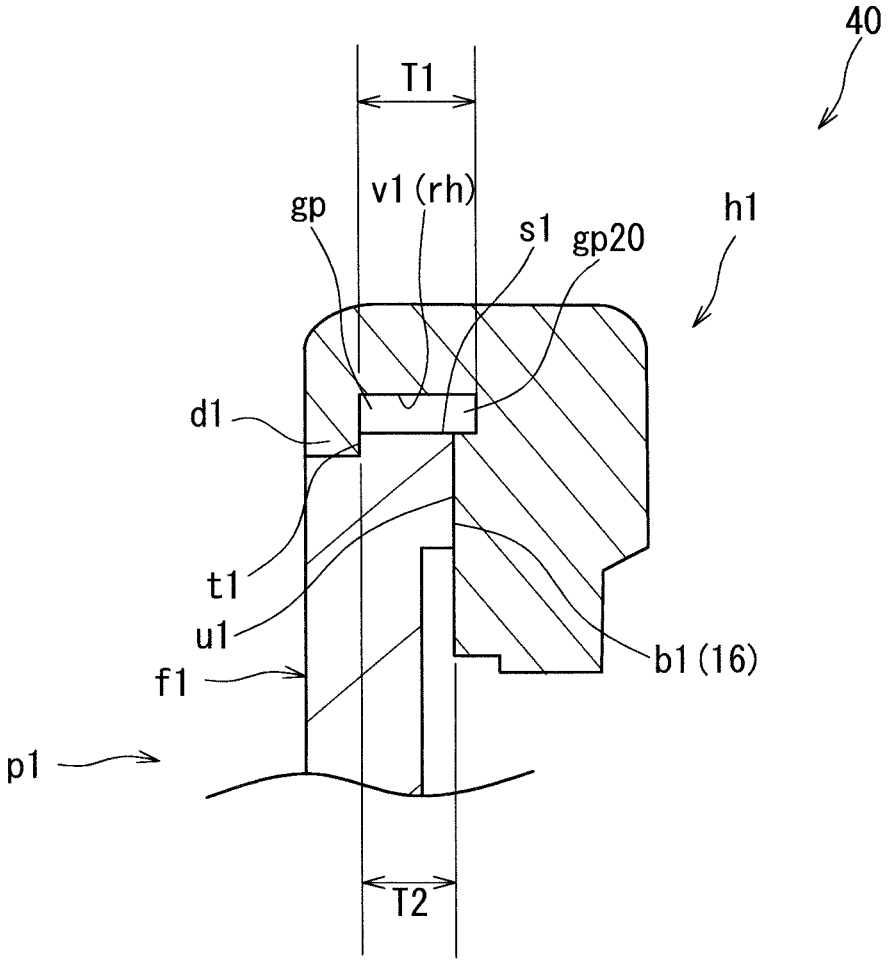
FIG. 14 is a partial sectional view of a head of a third embodiment.

FIG. 14 is a partial sectional view of a head 40 according to a third embodiment. Except for the form of a gap gp, the head 40 is the same as the above-mentioned head 2.

The head 40 includes a head body h1 and a face plate p1 fixed to the head body h1. The face plate p1 includes a plate front surface f1, a plate back surface b1, and a plate side surface s1. The plate front surface f1 includes a hitting face. The hitting face is a plane except for face grooves. The plate back surface b1 is a surface opposite to the plate front surface f1. The plate side surface s1 extends between the plate front surface f1 and the plate back surface b1. The head body h1 includes a receiving surface u1 which supports the plate back surface b1 of the face plate p1, and a body side surface v1 which is opposed to the plate side surface s1. A part of the plate back surface b1 (the protruded part 16) is brought into contact with the receiving surface u1. The body side surface v1 of the head body h1 includes a body recess rh. The body recess rh is a recess formed in the head body h1.

The head 40 includes the gap gp. The body recess rh forms the gap gp. The gap gp is formed between the plate side surface s1 and the body side surface v1.

The gap gp includes a back part gp20 located at back with respect to the receiving surface u1. The back part gp20 contributes to a further reduction in the rigidity of the head body h1. The back part gp20 can contribute to a further improvement in rebound performance.

The back part gp20 can effectively reduce the rigidity of the head body h1 near the receiving surface u1. The back part gp20 promotes the elastic deformation of the receiving surface u1, and promotes the displacement of the face plate p1 as a result. The back part gp20 can contribute to a further improvement in rebound performance.

As shown in FIG. 14, a front-rear direction width T1 of the gap gp is greater than a front-rear direction width T2 between a level difference surface t1 and the receiving surface u1. The greater width T1 contributes to a further reduction in the rigidity of the head body h1.

Figure 15:
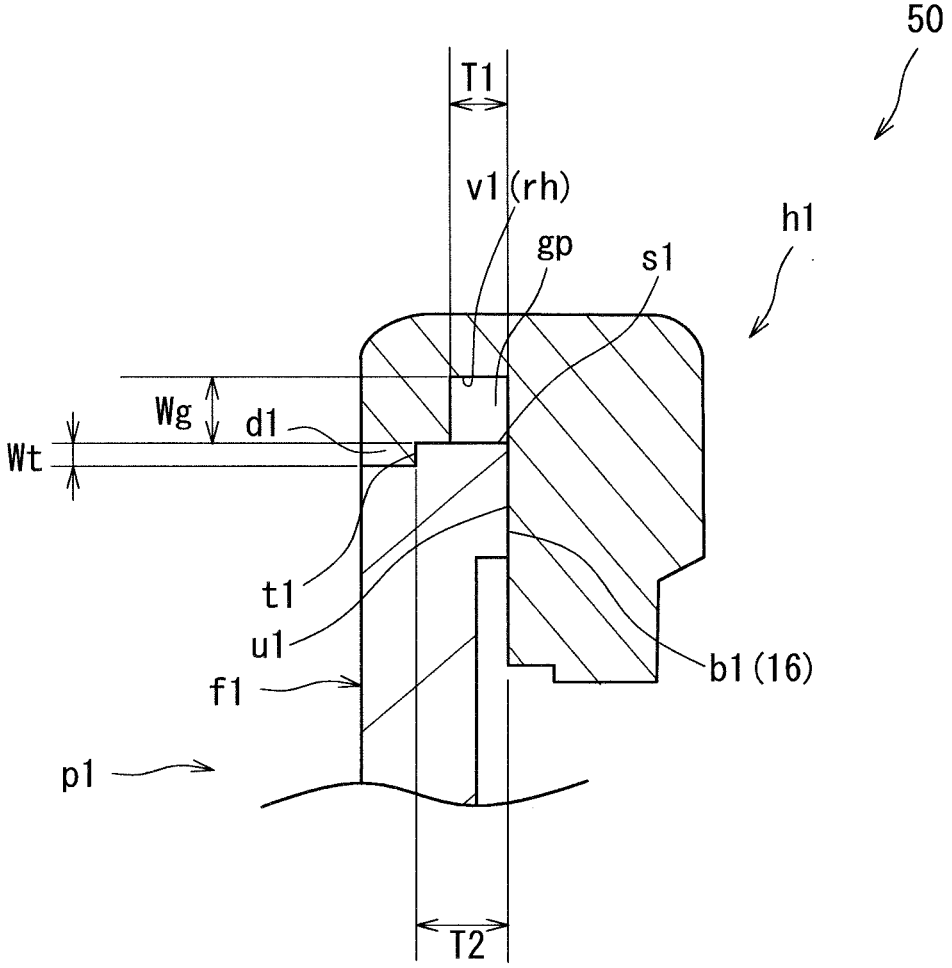
FIG. 15 is a partial sectional view of a head of a fourth embodiment.

FIG. 15 is a partial sectional view of a head 50 according to a fourth embodiment. Except for the form of a gap gp, the head 50 is the same as the above-mentioned head 2.

The head 50 includes a head body h1 and a face plate p1 fixed to the head body h1. The face plate p1 includes a plate front surface f1, a plate back surface b1, and a plate side surface s1. The plate front surface f1 includes a hitting face. The hitting face is a plane except for face grooves. The plate back surface b1 is a surface opposite to the plate front surface f1. The plate side surface s1 extends between the plate front surface f1 and the plate back surface b1. The head body h1 includes a receiving surface u1 which supports the plate back surface b1 of the face plate p1, and a body side surface v1 which is opposed to the plate side surface s1. A part of the plate back surface b1 (the protruded part 16) is brought into contact with the receiving surface u1. The body side surface v1 of the head body h1 includes a body recess rh. The body recess rh is a recess formed in the head body h1.

The head 50 includes the gap gp. The body recess rh forms the gap gp. The gap gp is formed between the plate side surface s1 and the body side surface v1.

A front-rear direction width T1 of the gap gp is smaller than a front-rear direction width T2 between a level difference surface t1 and the receiving surface u1. From viewpoint of the rule regulation of rebound performance or the like, the coefficient of restitution in the center of a face may be desired to be lowered. The small width T1 is useful for adjusting the coefficient of restitution.

A up-down direction width Wg of the gap gp is greater than a width Wt of the level difference surface t1. The greater width Wg can contribute to an improvement in rebound performance.

Figure 16:
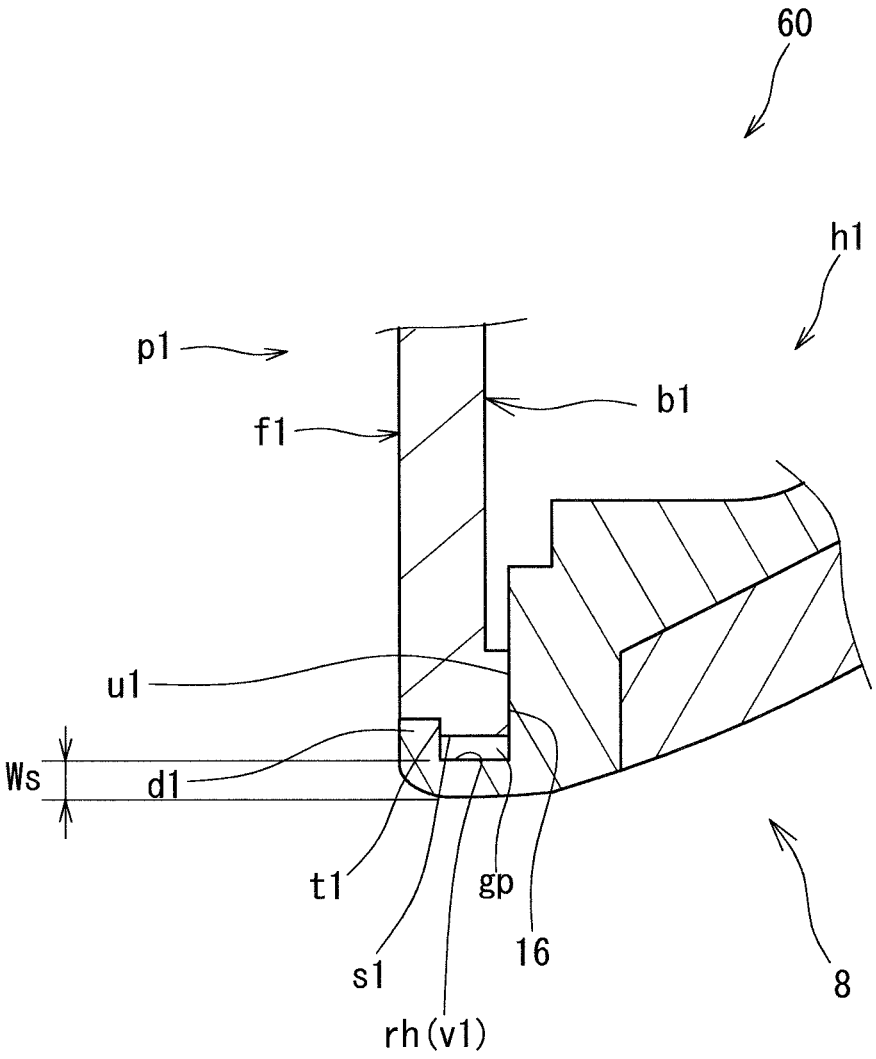
FIG. 16 is a partial sectional view of a head of a fifth embodiment.

FIG. 16 is a partial sectional view of a head 60 according to a fifth embodiment. In the head 60, a body recess rh is provided in a sole region. Therefore, a gap gp is provided in the sole region. Except for this point, the head 60 is the same as the head 2.

A up-down direction distance between a lowest point of a sole 8 and the gap gp is shown by a double-pointed arrow Ws in FIG. 16. The lowest point of the sole 8 is a point located at the lowermost position in the up-down direction. The lowest point of the sole 8 is set at each position of the toe-heel direction positions. From the viewpoint of reducing the rigidity of a sole portion to improve the rebound performance of the head, the distance Ws is preferably equal to or less than 4 mm, more preferably equal to or less than 3 mm, and still more preferably equal to or less than 2.5 mm. In light of the strength of the head, the distance Ws may be equal to or greater than 1.5 mm.

[Front-Rear Direction Width T1 of Gap gp (Front-Rear Direction Width T1 of Body Recess rh)]

From the viewpoint of improving the above-mentioned weight distribution effect and the degree of freedom of head designs, the width T1 is preferably equal to or greater than 1 mm, more preferably equal to or greater than 1.5 mm, and still more preferably equal to or greater than 2 mm. In light of the restriction on the size oup-down directionf the head, the width T1 is preferably equal to or less than 5 mm, more preferably equal to or less than 4 mm, and still more preferably equal to or less than 3 mm.

[Up-Down Direction Width Wg of Gap gp (Up-Down Direction Width Wg of Body Recess rh)]

From the viewpoint of improving the above-mentioned weight distribution effect and the degree of freedom of head designs, the width Wg is preferably equal to or greater than 0.2 mm, more preferably equal to or greater than 1 mm, and still more preferably equal to or greater than 2 mm. In light of the restriction on the size of the head, the width Wg is preferably equal to or less than 5 mm, more preferably equal to or less than 4 mm, and still more preferably equal to or less than 3 mm.

[Sectional Shape of Gap gp]

The sectional shape of the gap gp is not limited. In each of the above-mentioned embodiments, the sectional shape of the gap gp is a quadrangle (rectangle), but it may be any other sectional shape. Examples of the sectional shape of the gap gp include a triangle, a quadrangle, and a semicircle. The sectional shape of the gap gp may be an irregular shape.

The gap gp is not limited to one formed by the recess such as the plate recess rp and the body recess rh. For example, the gap gp may be formed by inclining at least a part of the plate side surface s1. For example, the gap gp may be formed by inclining at least a part of the body side surface v1.

[Sectional Area S of Gap gp]

The sectional area S of the gap gp is not limited. From the viewpoint of improving the above-mentioned weight distribution effect and the degree of freedom of head designs, the sectional area S is preferably equal to or greater than 0.2 $mm^2$, more preferably equal to or greater than 0.4 $mm^2$, and still more preferably equal to or greater than 0.6 $mm^2$. In light of the restriction on the size of the head, the sectional area S is preferably equal to or less than 12 $mm^2$, more preferably equal to or less than 8 $mm^2$, and still more preferably equal to or less than 4 $mm^2$. The sectional area S is measured in the section of a plane along the width direction of the outer peripheral edge part 16 and perpendicular to a hitting face. The width direction of the outer peripheral edge part 16 means the direction of a shortest line segment getting across the outer peripheral edge part 16, and is also a direction where the width Wa is measured.

Figure 17:
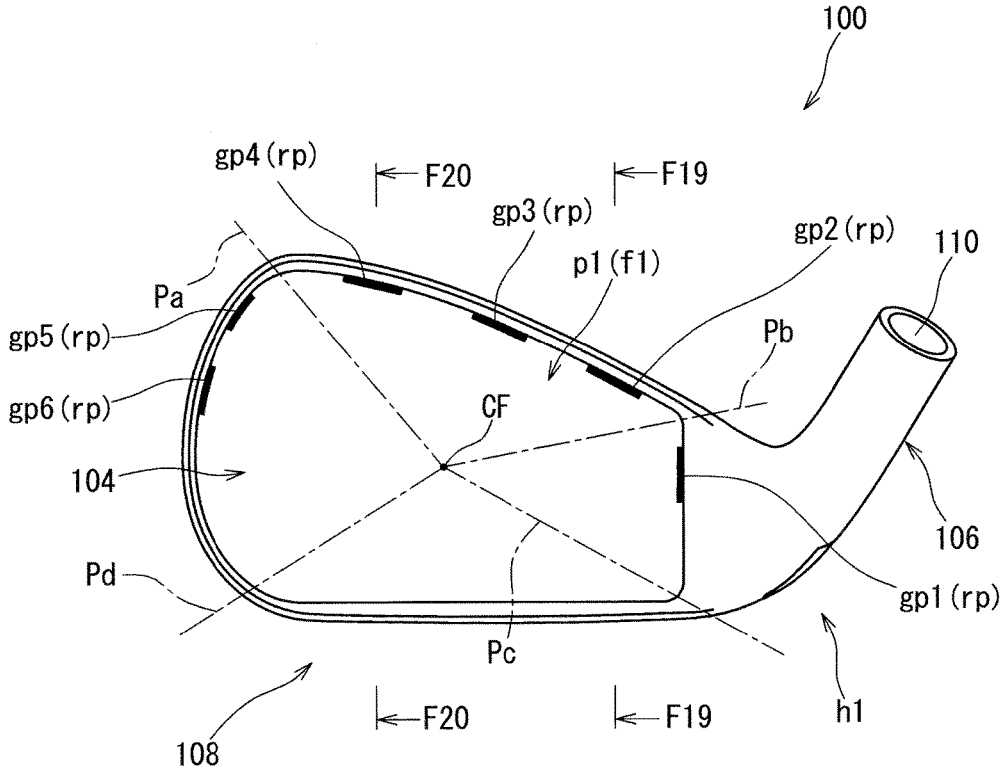
FIG. 17 is a front view of a head of a sixth embodiment, and the positions of gaps are shown by solid black in FIG. 17.
Figure 18:
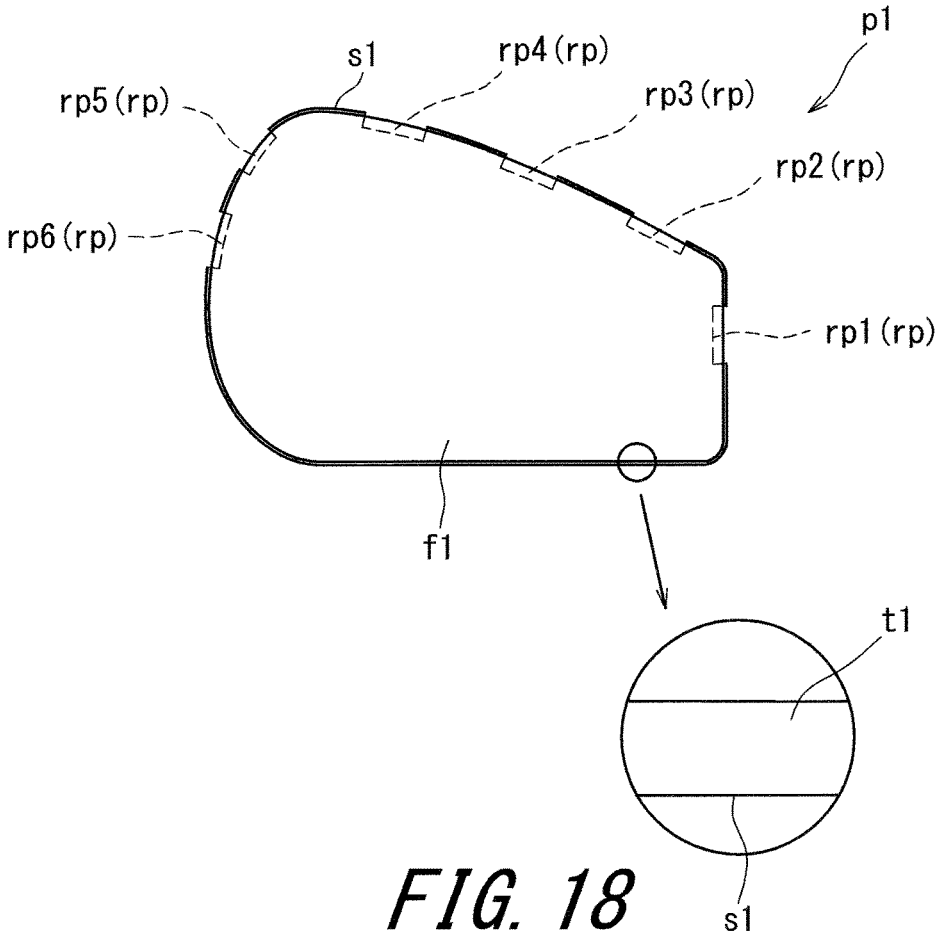
FIG. 18 is a plan view of a face plate according to the head of FIG. 17.
Figure 19:
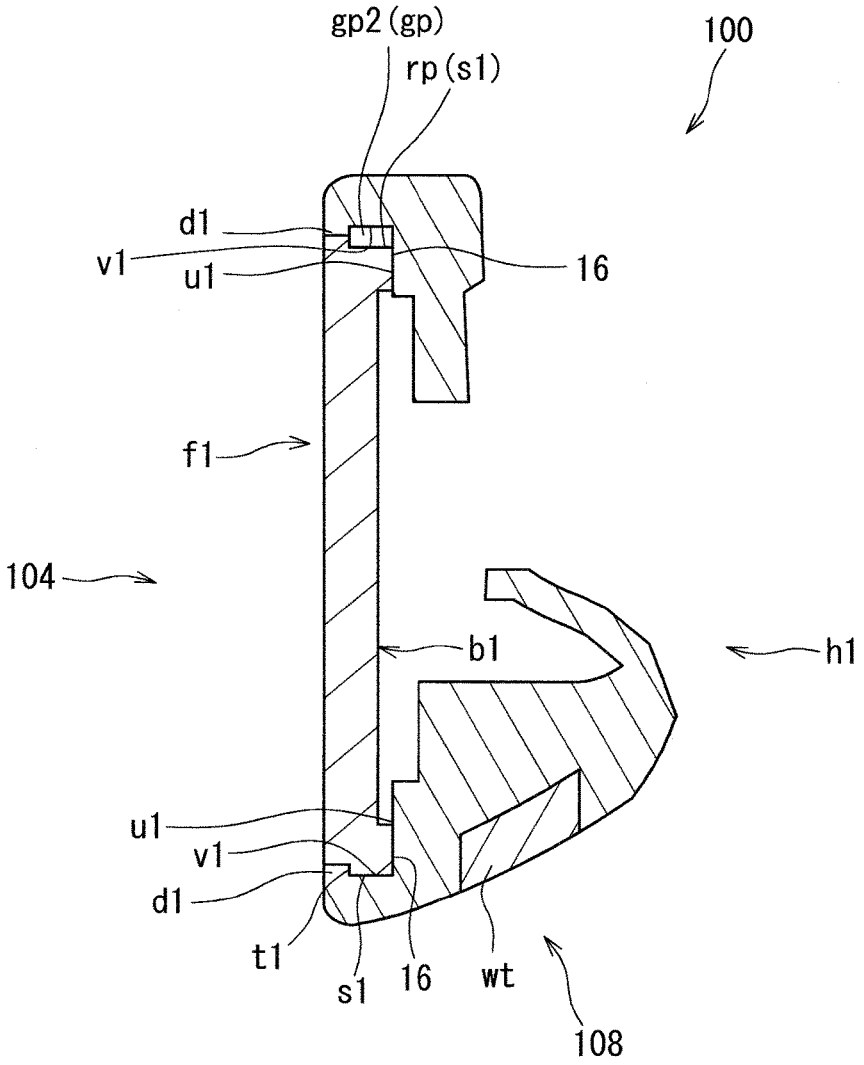
FIG. 19 is a sectional view taken along line F19-F19 of FIG. 17.
Figure 20:
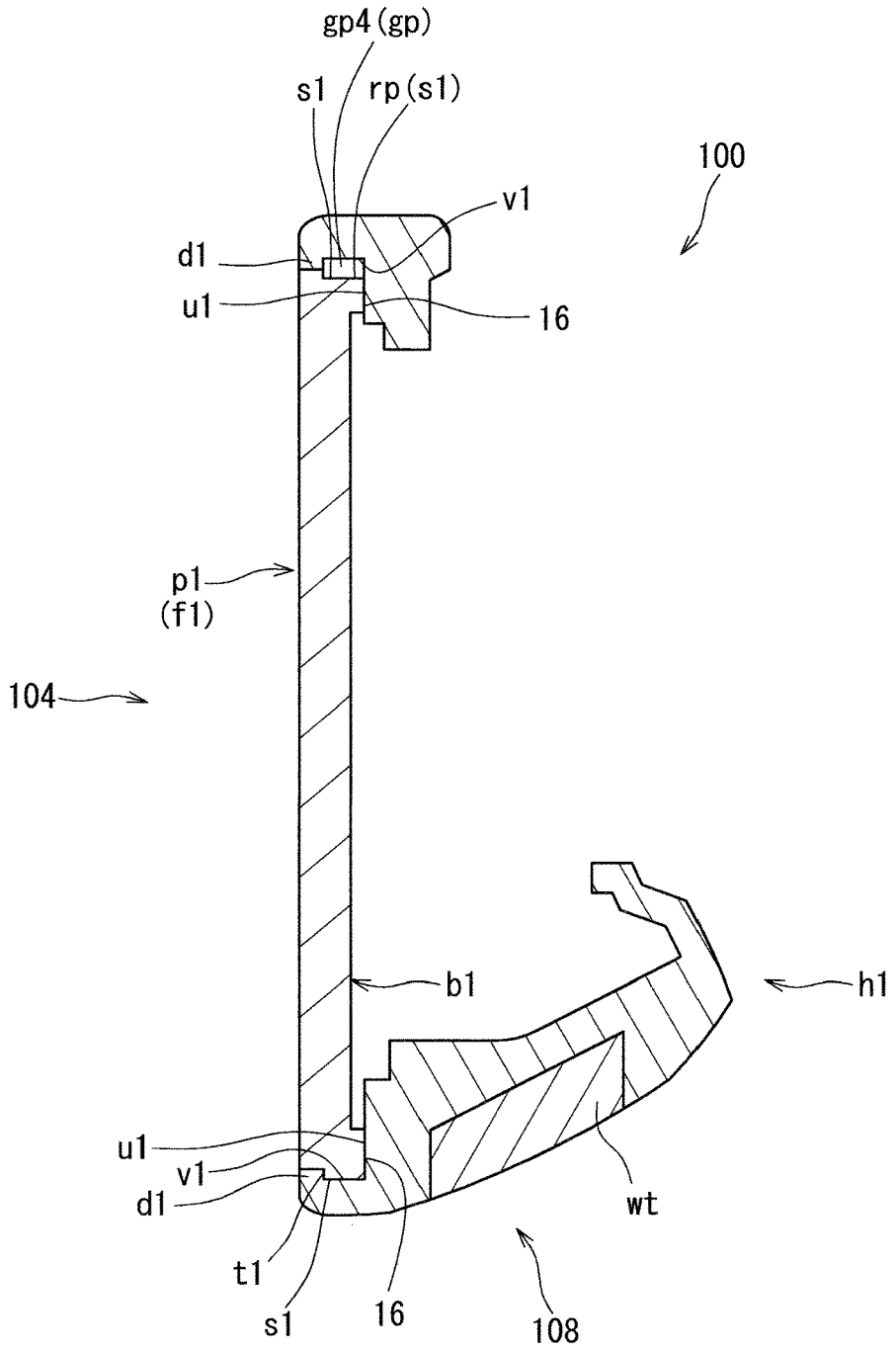
FIG. 20 is a sectional view taken along line F20-F20 of FIG. 17.

FIG. 17 is a front view of a golf club head 100 according to a sixth embodiment. FIG. 18 is a plan view of a face plate p1 used for the head 100. FIG. 19 is a sectional view taken along line F19-F19 of FIG. 17. FIG. 20 is a sectional view taken along line F20-F20 of FIG. 17.

The head 100 includes a face 104, a hosel 106, and a sole 108. The hosel 106 has a hosel hole 110. The face 104 is a hitting face. Although face grooves is formed in the surface of the face 104, the description of the face grooves is omitted. A weight member wt is disposed in the sole 108. The head 100 is an iron type golf club head. The head 100 is a cavity back iron.

The head 100 includes a head body h1 and a face plate p1 fixed to the head body h1. The head body h1 is made of a metal. In the present embodiment, the head body h1 is made of stainless steel. The face plate p1 is made of a metal. In the present embodiment, the face plate p1 is made of a titanium-based metal. The specific gravity of the face plate p1 is smaller than the specific gravity of the head body h1.

The face plate p1 includes a plate front surface f1, a plate back surface b1, and a plate side surface s1. The plate front surface f1 includes a hitting face. The hitting face is a plane except for face grooves. The plate back surface b1 is a surface opposite to the plate front surface f1. The plate side surface s1 extends between the plate front surface f1 and the plate back surface b1.

The head body h1 includes a receiving surface u1 which supports the plate back surface b1 of the face plate p1, and a body side surface v1 which is opposed to the plate side surface s1. A part of the plate back surface b1 is brought into contact with the receiving surface u1. The head body h1 includes a plastic deforming part d1 located at front of the face plate p1.

As shown in FIG. 19 and FIG. 20, the head 100 includes a gap gp. The gap gp is provided between the plate side surface s1 and the body side surface v1. The gap gp forms a space. The gap gp forms a hollow part.

A position in which the gap gp is provided is shown by a thick line in FIG. 17. Since the gap gp is the hollow part, in fact, the gap gp is not visually recognized from the outside of the head 100.

As shown in FIG. 17, the head 100 includes a first gap gp1, a second gap gp2, a third gap gp3, a fourth gap gp4, a fifth gap gp5, and a sixth gap gp6. The head 100 includes the gap gp1 located in a heel side region. The head 100 includes the gaps gp2, gp3, and gp4 located in a top side region. The head 100 includes the gaps gp5 and gp6 located in a toe side region. The head 100 includes the gaps gp1, gp2, and gp3 located on a heel side with respect to a center of a figure CF. The head 100 includes the gaps gp4, gp5, and gp6 located on a toe side with respect to the center of a figure CF. The head 100 includes the gaps gp2 and gp3 located in the top side region and located on a heel side with respect to the center of a figure CF. The head 100 includes the gap gp4 located in the top side region and located on a toe side with respect to the center of a figure CF. The head 100 includes the gaps gp5 and gp6 located in the toe side region and located above the center of a figure CF. In the head 100, the gap gp is not provided in a sole side region.

In the head 100, a recess rp is provided in the face plate p1. In order to distinguish the recess rp from another recess, the recess rp is also referred to as a plate recess. As shown in FIG. 18, the plate side surface s1 includes the plate recess rp. A plurality of plate recesses rp are provided. The face plate p1 has a simple shape, which is easily processed. Therefore, the plate recess rp is easily formed. For example, the plate recess rp may be formed by an NC process. The face plate p1 before being attached to the head body h1 is processed, and thereby the plate recess rp can be easily formed.

As shown in FIG. 18, the face plate p1 of the head 100 includes a first plate recess rp1, a second plate recess rp2, a third plate recess rp3, a fourth plate recess rp4, a fifth plate recess rp5, and a sixth plate recess rp6. In the head 100, the face plate p1 includes the plate recess rp1 located in a heel side region. In the head 100, the face plate p1 includes the plate recesses rp2, rp3, and rp4 located in the top side region. In the head 100, the face plate p1 includes the plate recess rp5 and rp6 located in the toe side region. In the head 100, the face plate p1 includes the plate recesses rp1, rp2, and rp3 located on the heel side with respect to the center of a figure CF. In the head 100, the face plate p1 includes the plate recesses rp4, rp5, and rp6 located on the toe side with respect to the center of a figure CF. In the head 100, the face plate p1 includes the plate recesses rp2 and rp3 located in the top side region and located on a heel side with respect to the center of a figure CF. In the head 100, the face plate p1 includes the plate recess rp4 located in the top side region and located on a toe side with respect to the center of a figure CF. In the head 100, the face plate p1 includes the plate recesses rp5 and rp6 located in the toe side region and located above the center of a figure CF. In the head 100, the plate recess rp is not provided in the sole side region.

The gap gp formed by the plate recess rp has a weight distribution effect. The gap gp is a redistribution weight creating part. The weight reduced by forming the gap gp can be redistributed to other sites of the head 100. The gap gp improves the degree of freedom of head designs.

For example, the gap gp can be disposed so that the center of gravity of the head is low. For example, the gap gp located vertically above the center of gravity of the head contributes to the lowering of the center of gravity of the head. For example, the gap gp can be disposed so that the upper-and-lower moment of inertia of the head is increased. For example, the gap gp can be disposed so that the left-and-right moment of inertia of the head is increased.

As described above, the gap gp is easily formed. For example, the gap gp can be easily formed by forming a recess in the plate side surface s1 of the face plate p1, or the body side surface v1 of the head body h1*p*. The recess can be produced by a NC process, for example. The position and the volume of the gap gp can be optionally selected. Furthermore, the gap gp is formed in the joining part of the face plate p1 and the head body h1, which can effectively promote the deformation of the face plate p1.

Figure 21:
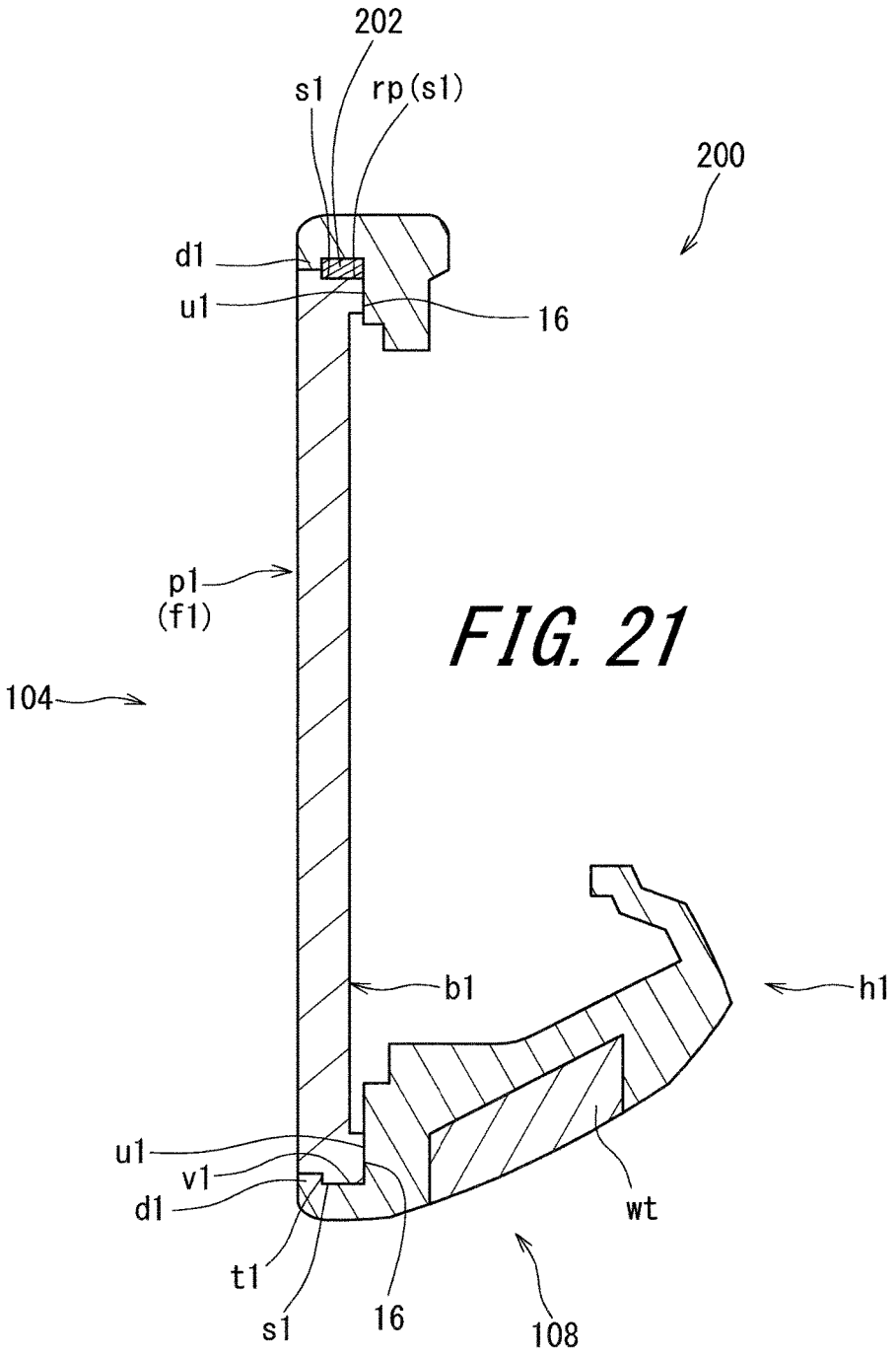
FIG. 21 is a sectional view of a head of a seventh embodiment.

FIG. 21 is a sectional view of a head 200 according to a seventh embodiment.

The head 200 is a head in which a resin member 202 is disposed in a gap gp of a head 100. That is, in the head 200, the resin member 202 is provided in the gap gp. Except for the existence of the resin member 202, the head 200 is the same as the head 100. The existence of the gap gp may cause abnormal noise. The abnormal noise occurs when the head is vibrated, for example. The resin member 202 contributes to a reduction in the abnormal noise.

The resin member 202 may be previously molded, and then disposed. The resin member 202 may be disposed by a method including filling the recess (body recess rh or plate recess rp) with a resin by means such as application or injection and thereafter curing the resin.

Examples of the resin of the resin member 202 include a thermosetting resin and a thermoplastic resin. Examples of the thermosetting resin include a phenol resin, an epoxy resin, a melamine resin, a urea resin, an unsaturated polyester resin, an alkyd resin, polyurethane, and thermosetting polyimide. Examples of the thermoplastic resin include polyethylene, high-density polyethylene, medium-density polyethylene, low-density polyethylene, polypropylene, polyvinyl chloride, polyvinylidene chloride, polystyrene, polyvinyl acetate, polyurethane, polytetrafluoroethylene, an ABS resin (acrylonitrile butadiene styrene resin), an AS resin, an acrylic resin, nylon, polyacetal, polycarbonate, modified polyphenylene ether, polyethylene terephthalate, polybutylene terephthalate, cyclic polyolefin, polyphenylene sulfide, polytetrafluoroethylene, polysulfone, polyether sulfone, and polyether ether ketone. Fiber reinforced resins such as a carbon fiber reinforced resin may also be used.

Figure 22:
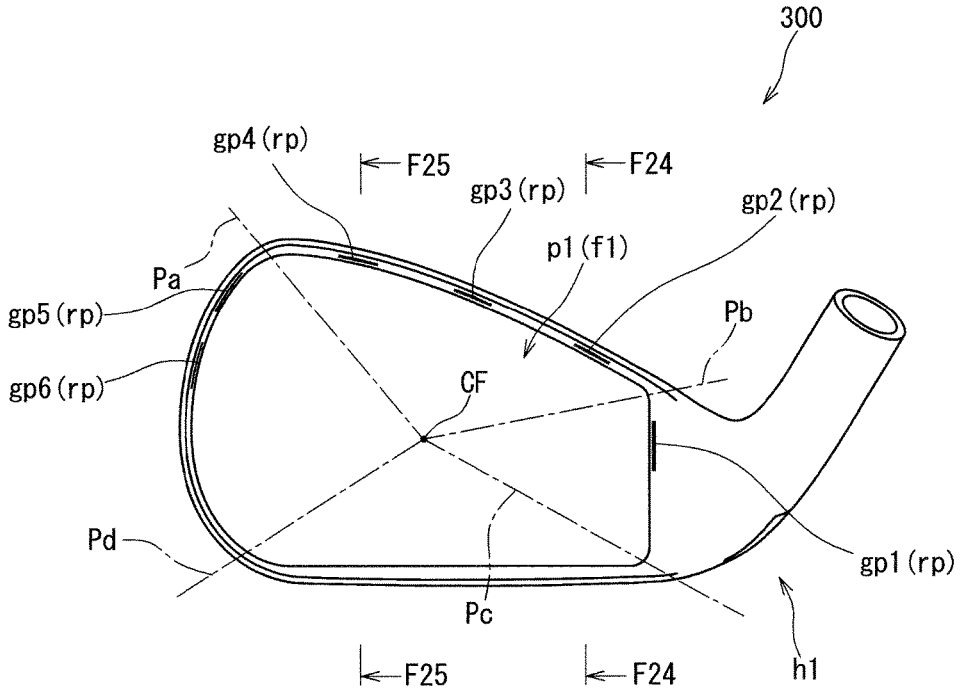
FIG. 22 is a front view of a head of an eighth embodiment.
Figure 23:
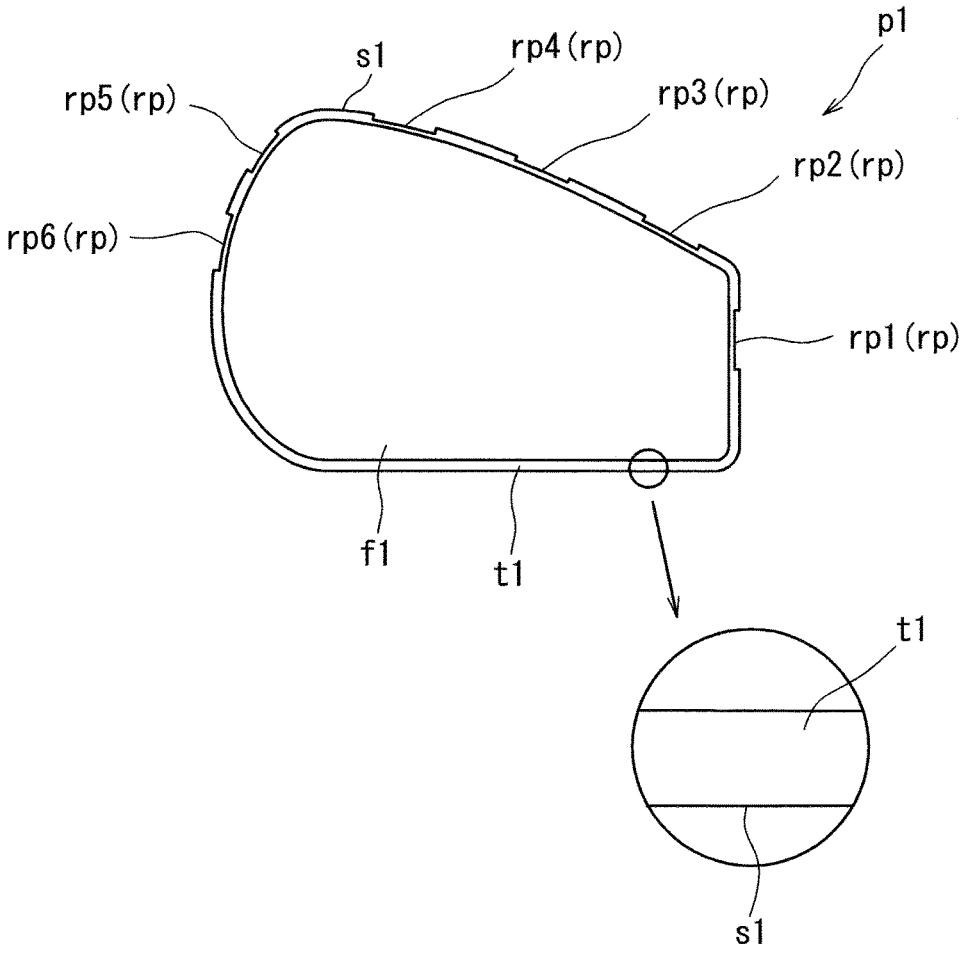
FIG. 23 is a plan view of a face plate according to the head of FIG. 22.
Figure 24:
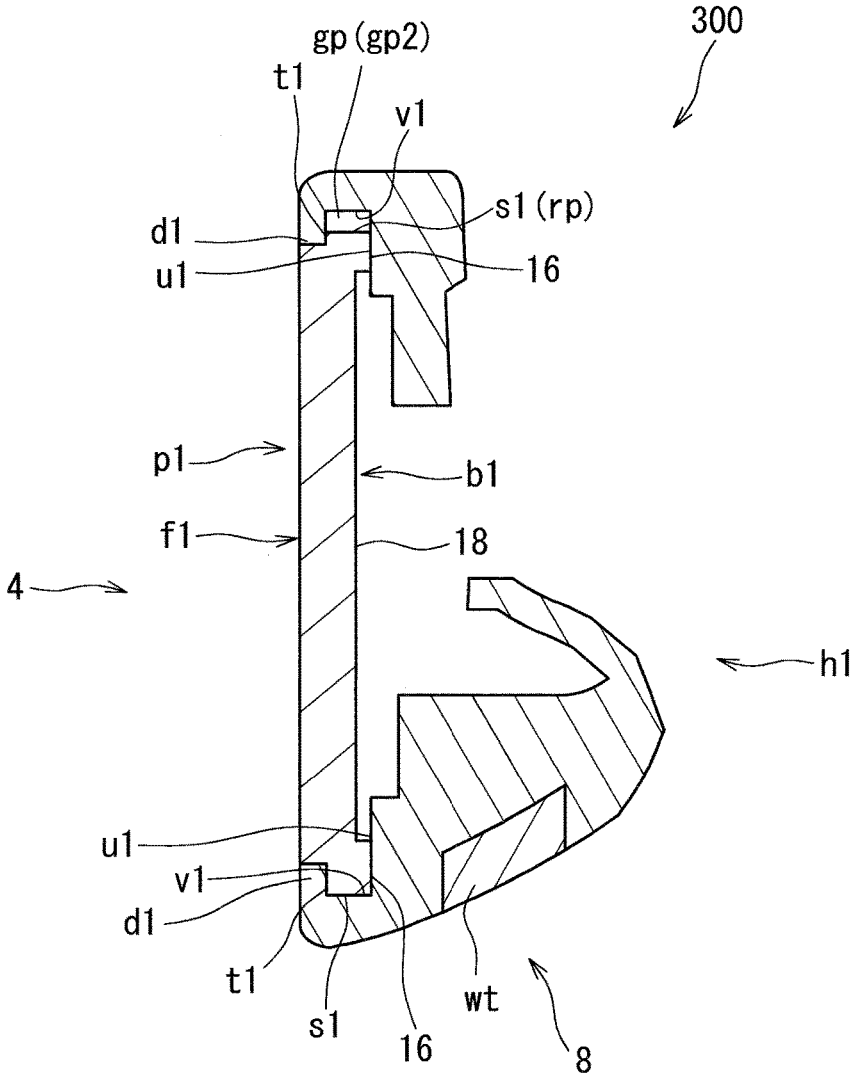
FIG. 24 is a sectional view taken along line F24-F24 of FIG. 22.
Figure 25:
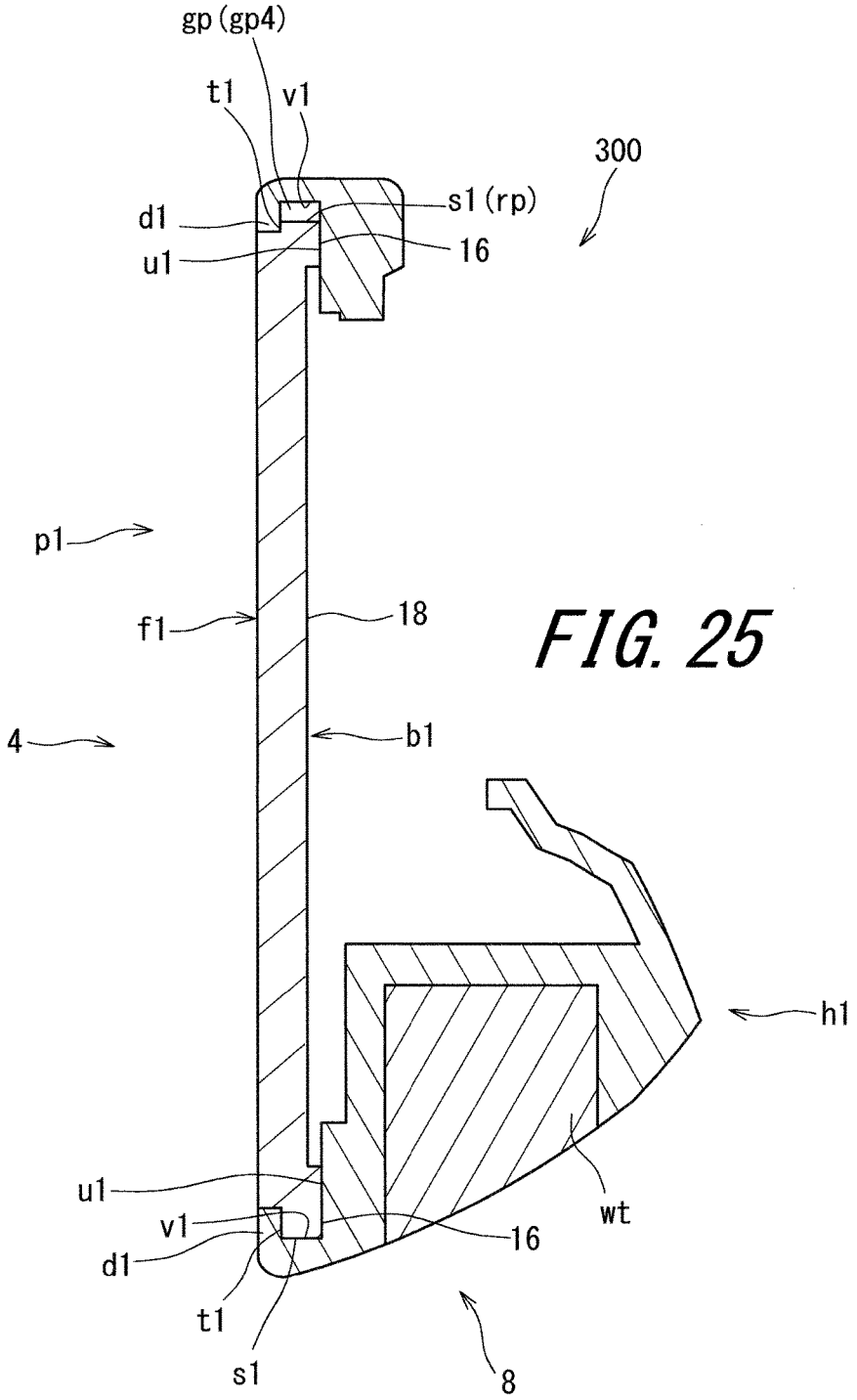
FIG. 25 is a sectional view taken along line F25-F25 of FIG. 22.

FIG. 22 is a front view of a golf club head 300 according to an eighth embodiment. FIG. 23 is a plan view of a face plate p1 used for the head 300. FIG. 24 is a sectional view taken along line F24-F24 of FIG. 22. FIG. 25 is a sectional view taken along line F25-F25 of FIG. 22.

The head 300 includes a head body h1 and a face plate p1 fixed to the head body h1. The head body h1 is made of a metal. In the present embodiment, the head body h1 is made of stainless steel. The face plate p1 is made of a metal. In the present embodiment, the face plate p1 is made of a titanium-based metal. The specific gravity of the face plate p1 is smaller than the specific gravity of the head body h1.

The face plate p1 includes a plate front surface f1, a plate back surface b1, and a plate side surface s1. The plate front surface f1 includes a hitting face. The hitting face is a plane except for face grooves. The plate back surface b1 is a surface opposite to the plate front surface f1. The plate side surface s1 extends between the plate front surface f1 and the plate back surface b1.

The head body h1 includes a receiving surface u1 which supports the plate back surface b1 of the face plate p1, and a body side surface v1 which is opposed to the plate side surface s1. A part of the plate back surface b1 is brought into contact with the receiving surface u1. The head body h1 includes a plastic deforming part d1 located at front of the face plate p1.

As shown in FIG. 24 and FIG. 25, the head 300 includes a gap gp. The gap gp is provided between the plate side surface s1 and the body side surface v1. The gap gp forms a space. The gap gp forms a hollow part.

A position in which the gap gp is provided is shown by a thick line in FIG. 22. Since the gap gp is the hollow part, in fact, the gap gp is not visually recognized from the outside of the head 300.

As shown in FIG. 22, the head 300 includes a first gap gp1, a second gap gp2, a third gap gp3, a fourth gap gp4, a fifth gap gp5, and a sixth gap gp6.

As shown in FIG. 23, the plate side surface s1 includes a plate recess rp. A plurality of plate recesses rp are provided.

As shown in FIG. 23, the face plate p1 of the head 300 includes a first plate recess rp1, a second plate recess rp2, a third plate recess rp3, a fourth plate recess rp4, a fifth plate recess rp5, and a sixth plate recess rp6. The gap gp is formed by these plate recesses rp.

As shown in FIG. 23, in the present embodiment, a level difference surface t1 exists in a region corresponding to the plate recess rp. For this reason, as shown in FIG. 24 and FIG. 25, the plastic deforming part d1 is provided in the region corresponding to the plate recess rp.

The constitution of the head 300 is different from the constitution of the head 100 (FIG. 17 to FIG. 20). In the head 100, the level difference surface t1 does not exist in the region corresponding to the plate recess rp (gap gp) (see FIG. 18, FIG. 19, and FIG. 20). Therefore, the plastic deforming part d1 located in the region corresponding to the plate recess rp (gap gp) is not located at front of the face plate p1, and does not achieve a function to prevent the face plate p1 from coming off. When the level difference surface t1 receiving the plastic deforming part d1 formed in a caulking step does not exist, the poor formation of the plastic deforming part d1 may occur. The poor formation of the plastic deforming part d1 may cause the poor shape of the gap gp.

In the head 300, the level difference surface t1 and the plastic deforming part d1 are provided in the region corresponding to the gap gp (plate recess rp) (see FIG. 24 and FIG. 25). For this reason, the face plate p1 is more certainly fixed. Furthermore, the existence of the level difference surface t1 suppresses the poor formation of the plastic deforming part d1 and the poor shape of the gap gp.

From the viewpoints of fixing the face plate p1 and of forming the plastic deforming part d1, the level difference surface t1 and the plastic deforming part d1 are preferably provided in at least a part of the region corresponding to the gap gp, and the level difference surface t1 and the plastic deforming part d1 are preferably provided in the whole region corresponding to the gap gp.

"The region corresponding to the gap gp" means a region which overlaps with the gap gp in planar view as shown in FIG. 22, and a region adjacent to the gap gp in the planar view. Similarly, "the region corresponding to the plate recess rp" means a region which overlaps with the plate recess rp in planar view as shown in FIG. 22, and a region adjacent to the plate recess rp in the planar view. Similarly, "the region corresponding to the body recess rh" means a region which overlaps with the body recess rh in planar view as shown in FIG. 3, and a region adjacent to the body recess rh in the planar view.

[Non-Visibility]

The gap gp formed by the plate recess rp or the body recess rh may be formed so that the gap gp is not visible from the outside. Therefore, the gap gp does not cause the uncomfortable feeling of an external appearance and the restriction on designs. Since golf is a mental sport, the uncomfortable feeling caused by the external appearance can influence the accuracy of shots. The non-visibility of the gap gp can contribute to an improvement in the accuracy of shots.

The gap gp may be provided over the whole circumference of the face plate. The gap gp may be provided on a part of the circumference of the face plate. The gap gp may be entirely provided between the plate side surface s1 and the body side surface v1, or may be partially provided between the plate side surface s1 and the body side surface v1.

[Dispersion of Gap gp]

As described above, the gap gp may be provided at one place, or dispersed to two or more places. The gap gp may be provided at two places, three places, or four or more places. Examples of the specification of dispersion include the following constitutions. Two or more selected from the group consisting of these constitutions (1) to (11) may be combined.

(1) The gap gp is dispersed to the toe side of the center of a figure CF and the heel side of the center of a figure CF.

(2) The gap gp is dispersed to the upper side of the center of a figure CF and the lower side of the center of a figure CF.

(3) The gap gp is dispersed to the top side region and the sole side region.

(4) The gap gp is dispersed to the toe side region and the heel side region.

(5) The gap gp is dispersed to two or more places selected from the group consisting of the top side region, the sole side region, the toe side region, and the heel side region.

(6) The gap gp is dispersed to three or more places selected from the group consisting of the top side region, the sole side region, the toe side region, and the heel side region.

(7) The gap gp is dispersed to the top side region, the sole side region, the toe side region, and the heel side region.

(8) In the top side region, the gap gp is dispersed to the toe side of the center of a figure CF and the heel side of the center of a figure CF.

(9) In the sole side region, the gap gp is dispersed to the toe side of the center of a figure CF and the heel side of the center of a figure CF.

(10) In the toe side region, the gap gp is dispersed to the lower side of the center of a figure CF and the upper side of the center of a figure CF.

(11) In the heel side region, the gap gp is dispersed to the lower side of the center of a figure CF and the upper side of the center of a figure CF.

By the existence of the gap gp, the plate side surface s1 is separated from the body side surface v1. However, when the plate side surface s1 and the body side surface v1 are partially brought into contact with each other, the face plate p1 can be positioned, and the fixation of the face plate p1 is secured. From this viewpoint, the plate side surface s1 and the body side surface v1 are preferably brought into contact with each other in each of the top side region, the sole side region, the toe side region, and the heel side region. In this case, the face plate p1 is easily positioned with respect to the head body h1.

From the viewpoint of rebound performance, the gap gp preferably exists on the circumference of the face plate p1. From this viewpoint, the gap gp preferably exists at two or more places selected from the group consisting of the top side region, the sole side region, the toe side region, and the heel side region. The gap gp more preferably exists at three or more places selected from the group consisting of the top side region, the sole side region, the toe side region, and the heel side region. The gap gp more preferably exists in each of the top side region, the sole side region, the toe side region, and the heel side region.

The peripheral length of the face plate p1 is defined as Lp, and the extension length of the gap gp is defined as Lg. The length Lp is the length of a contour line 20 of the plate back surface b1. The extension length Lg is the length of the outer edge of the gap gp when the gap gp is seen in planar view as shown in FIG. 3. When a plurality of gaps gp exist, the total of the lengths of the gaps gp is the length Lg.

From the viewpoint of improving the above-mentioned weight distribution effect and the degree of freedom of head designs, Lg/Lp is preferably equal to or greater than 0.1, more preferably equal to or greater than 0.2, and still more preferably equal to or greater than 0.3. From the viewpoint of positioning the face plate p1, Lg/Lp is preferably equal to or less than 0.9, more preferably equal to or less than 0.8, and still more preferably equal to or less than 0.7.

EXAMPLES

Hereinafter, the effects of the present invention will be clarified by Examples. However, the present invention should not be interpreted in a limited way based on the description of Examples.

Example 1

The same head as the above-mentioned head 2 was produced. A face plate p1 and a head body (undeformed body) hip were prepared. The head body h1*p* was produced by casting. A weight member wt was attached to a sole part of the head body h1*p*. The weight member wt was made of a tungsten nickel alloy. The head body h1*p* included an undeformed projection d2. The undeformed projection d2 was formed on the whole circumference of an opening part 14. The head body h1*p* was made of stainless steel (SUS630). The face plate p1 was cut from a plate material (rolling material). An outer peripheral edge part 16 as a protruded part was produced by an NC process. The face plate p1 was made of a titanium alloy. As the titanium alloy, Super-TIX (registered trademark) manufactured by Nippon Steel & Sumitomo Metal Corporation was used.

A body side surface v1 of the undeformed body h1*p* was cut by an NC process, to form a body recess rh. The face plate p1 was fitted into the opening part 14 of the head body h1*p*. Next, by performing the above-mentioned caulking step, the undeformed projection d2 was changed to a plastic deforming part d1. Thus, a head of Example 1 was obtained.

Example 2

The same head as the above-mentioned head 100 was produced. A face plate p1 and a head body (undeformed body) h1*p* were prepared. The head body h1*p* was produced by casting. A weight member wt was attached to a sole part of the head body h1*p*. The weight member wt was made of a tungsten nickel alloy. The head body h1*p* included an undeformed projection d2. The undeformed projection d2 was formed on the whole circumference of an opening part 14. The head body h1*p* was made of stainless steel (SUS630). The face plate p1 was cut from a plate material (rolling material). An outer peripheral edge part 16 as a protruded part was produced by an NC process. Furthermore, the plate side surface s1 was cut by an NC process, to form a plate recess rp. The face plate p1 was made of a titanium alloy. As the titanium alloy, Super-TIX (registered trademark) manufactured by Nippon Steel & Sumitomo Metal Corporation was used.

The face plate p1 was fitted into the opening part 14 of the head body h1*p*. Next, by performing the above-mentioned caulking step, the undeformed projection d2 was changed to a plastic deforming part d1. Thus, a head of Example 2 was obtained.

In Example 1, in the head body h1*p* before the face plate p1 was attached, the body recess rh was formed in the body side surface v1. In Example 2, in the face plate p1 before being attached to the head body h1*p*, the plate recess rp was formed in the plate side surface s1. In each of Examples, the recess could be easily formed. That is, in each of Examples, the gap gp was easily formed.

As described above, the advantages of the present invention are apparent.

The description hereinabove is merely for an illustrative example, and various modifications can be made in the scope not to depart from the principles of the present invention.

The present invention can be applied to all golf club heads such as a wood type head, a utility type head, a hybrid type head, an iron type head, and a putter head.

What is claimed is:

1. A golf club head comprising:

a head body; and a face plate fixed to the head body, wherein:

the face plate includes a plate front surface having a hitting face, a plate back surface disposed on an opposite side of the plate front surface, and a plate side surface disposed on the face plate periphery;

the head body includes a body side surface opposed to the plate side surface;

a gap is provided between the plate side surface and the body side surface on at least a portion of the face plate periphery;

a peripheral portion of the plate front surface includes a level difference surface which is recessed behind the hitting face;

the head body includes a plastic deforming part that covers the front of the level difference surface; and the level difference surface and the plastic deforming part are disposed in at least a portion of a region corresponding to the gap.

2. The golf club head according to claim 1, wherein:
the plate side surface includes a plate recess; and
the plate recess forms the gap.

3. The golf club head according to claim 1, wherein:
the body side surface includes a body recess; and
the body recess forms the gap.

4. The golf club head according to claim 1, further comprising a resin member, wherein the resin member is disposed in the gap.

5. The golf club head according to claim 1,
wherein the plate side surface includes a top side region, a sole side region, a toe side region and a heel side region; and
the plate side surface contacts the body side surface in each of the top side region, the sole side region, the toe side region, and the heel side region.

6. The golf club head according to claim 1,
wherein the plate back surface includes an outer peripheral edge part disposed at a peripheral portion of the plate back surface; and
a peripheral width of the outer peripheral edge part is equal to or greater than 1 mm but equal to or less than 6 mm.

7. The golf club head according to claim 1, wherein the plate back surface includes an outer peripheral edge part; and the outer peripheral edge part protrudes backward of the plate back surface.

8. The golf club head according to claim 1, wherein a width of the level difference surface is equal to or greater than 0.2 mm but equal to or less than 2 mm.

9. The golf club head according to claim 1, wherein a vertical direction width of the gap is greater than a width of the level difference surface.

10. The golf club head according to claim 1, wherein the head body includes a sole; and an up-down direction distance between a lowest point of the sole and the gap is equal to or greater than 1.5 mm and equal to or less than 4 mm.

11. The golf club head according to claim 1, wherein an up-down direction width of the gap is equal to or greater than 0.2 mm but equal to or less than 5 mm.

12. The golf club head according to claim 1,
wherein the head includes a top side region, a sole side region, a toe side region and a heel side region; and
the gap exists at two or more places selected from the group consisting of the top side region, the sole side region, the toe side region and the heel side region.

13. The golf club head according to claim 1,
wherein the head includes a top side region, a sole side region, a toe side region and a heel side region; and
the gap exists at three or more places selected from the group consisting of the top side region, the sole side region, the toe side region and the heel side region.

* * * * *